US008723909B2

(12) United States Patent
Asai et al.

(10) Patent No.: US 8,723,909 B2
(45) Date of Patent: May 13, 2014

(54) LASER REWRITING APPARATUS

(71) Applicants: Toshiaki Asai, Shizuoka (JP); Yoshihiko Hotta, Shizuoka (JP); Shinya Kawahara, Shizuoka (JP); Tomomi Ishimi, Shizuoka (JP)

(72) Inventors: Toshiaki Asai, Shizuoka (JP); Yoshihiko Hotta, Shizuoka (JP); Shinya Kawahara, Shizuoka (JP); Tomomi Ishimi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/680,943

(22) Filed: Nov. 19, 2012

(65) Prior Publication Data

US 2013/0141512 A1 Jun. 6, 2013

(30) Foreign Application Priority Data

Dec. 5, 2011 (JP) ..... 2011-265372

(51) Int. Cl.

| | |
|---|---|
| ***B41J 2/00*** | (2006.01) |
| ***B41J 2/47*** | (2006.01) |
| ***B41J 27/00*** | (2006.01) |
| ***B41J 2/435*** | (2006.01) |

(52) U.S. Cl.

USPC ..... 347/259; 347/110; 347/251; 347/260; 347/262; 347/264

(58) Field of Classification Search

USPC ..... 347/110, 251, 256, 258, 259, 260, 262, 347/264

See application file for complete search history.

(56) References Cited

U.S. PATENT DOCUMENTS

| | | | | |
|---|---|---|---|---|
| 8,098,266 | B2 | 1/2012 | Asai et al. | |
| 8,284,222 | B2 | 10/2012 | Ishimi et al. | |
| 8,293,679 | B2 | 10/2012 | Asai et al. | |
| 2007/0285488 | A1* | 12/2007 | Ishimi et al. | 347/179 |
| 2008/0192618 | A1* | 8/2008 | Nakata et al. | 369/120 |
| 2010/0069238 | A1 | 3/2010 | Asai et al. | |
| 2011/0090296 | A1 | 4/2011 | Ishimi et al. | |
| 2011/0090299 | A1 | 4/2011 | Asai et al. | |
| 2011/0207603 | A1 | 8/2011 | Kawahara et al. | |
| 2012/0212564 | A1 | 8/2012 | Yamamoto et al. | |
| 2012/0218540 | A1 | 8/2012 | Ishimi et al. | |

FOREIGN PATENT DOCUMENTS

| | | |
|---|---|---|
| JP | 5-008537 | 1/1993 |
| JP | 7-179061 | 7/1995 |
| JP | 9-030118 | 2/1997 |
| JP | 11-151856 | 6/1999 |
| JP | 2000-136022 | 5/2000 |
| JP | 2003-320692 | 11/2003 |
| JP | 2004-265247 | 9/2004 |

(Continued)

*Primary Examiner* — Alessandro Amari
*Assistant Examiner* — Kendrick Liu
(74) *Attorney, Agent, or Firm* — Oblon, Spivak, McClelland, Maier & Neustadt, L.L.P.

(57) ABSTRACT

A laser rewriting apparatus positioned on one side or the other side of a conveyance path through which a to-be-conveyed object on which a thermoreversible recording medium is affixed is conveyed in a predetermined conveyance direction. The laser rewriting apparatus emits laser light to the thermoreversible recording medium and rewrites an image. The laser writing apparatus includes an image erasing apparatus that emits laser light to the thermoreversible recording medium and erases the image from the thermoreversible recording medium; and an image recording apparatus positioned on the predetermined conveyance direction downstream side of the image erasing apparatus and records a new image by emitting laser light to the thermoreversible recording medium. The image erasing apparatus and the image recording apparatus have the respective laser light emitting parts from which the laser light is emitted at ends on the same side with respect to the predetermined conveyance direction.

12 Claims, 18 Drawing Sheets

(56) References Cited

FOREIGN PATENT DOCUMENTS

| | | |
|---|---|---|
| JP | 2004-265249 | 9/2004 |
| JP | 2007-076768 | 3/2007 |
| JP | 2008-194905 | 8/2008 |
| JP | 2010-280498 | 12/2010 |
| JP | 2011-104995 | 6/2011 |

* cited by examiner

LASER REWRITING APPARATUS

BACKGROUND OF THE INVENTION

1. Field of the Invention

The present invention relates to a laser rewriting apparatus, and in more detail, to a laser rewriting apparatus that rewrites an image by emitting laser light to a thermoreversible recording medium.

2. Description of the Related Art

A laser rewriting apparatus in the related art is positioned on one side or the other side of a conveyance path through which a to-be-conveyed object is conveyed in a predetermined conveyance direction on which object a thermoreversible recording medium is affixed (see Japanese Laid-Open Patent Application No. 2008-194905, for example). The laser rewriting apparatus emits laser light to the thermoreversible recording medium and rewrites an image.

The laser writing apparatus in the related art includes an image erasing apparatus and an image recording apparatus. The image erasing apparatus emits laser light to the thermoreversible recording medium on which the image is recorded and erases the image. The image recording apparatus is positioned on the predetermined conveyance direction downstream side of the image erasing apparatus and records a new image by emitting laser light to the thermoreversible recording medium from which the image has been erased by the image erasing apparatus.

However, when the interval between the image erasing apparatus and the image recording apparatus is large, throughput may be degraded since the period of time required for rewriting the image becomes long. When the interval between the image erasing apparatus and the image recording apparatus is short, it may not be possible to carry out an erasing operation on the thermoreversible recording medium of one to-be-conveyed object by the image erasing apparatus and a recording operation on the thermoreversible recording medium of another to-be-conveyed object by the image recording apparatus in parallel, depending on the size of the to-be-conveyed objects on which the thermoreversible recording media are affixed, respectively, for example.

SUMMARY OF THE INVENTION

According to one embodiment, a laser rewriting apparatus is positioned on one side or the other side of a conveyance path through which a to-be-conveyed object on which a thermoreversible recording medium is affixed is conveyed in a predetermined conveyance direction. The laser rewriting apparatus emits laser light to the thermoreversible recording medium and rewrites an image. The laser writing apparatus includes an image erasing apparatus and an image recording apparatus. The image erasing apparatus emits laser light to the thermoreversible recording medium on which the image is recorded and erases the image. The image recording apparatus is positioned on the predetermined conveyance direction downstream side of the image erasing apparatus and records a new image by emitting laser light to the thermoreversible recording medium from which the image has been erased by the image erasing apparatus. The image erasing apparatus and the image recording apparatus have respective laser light emitting parts from which the laser light is emitted at ends of the same side with respect to the predetermined conveyance direction.

Other objects, features and advantages of the present invention will become more apparent from the following detailed description when read in conjunction with the accompanying drawings.

DETAILED DESCRIPTION OF THE EMBODIMENTS

Below, a first embodiment of the present invention will be described based on FIGS. 1A, 1B, 2A, 2B, 3A, 3B, 4A and 4B. FIGS. 1A, 1B, 2A and 2B show a general configuration of a laser rewriting apparatus 100 according to the first embodiment.

The laser rewriting apparatus 100 emits laser light to a rewritable label RL that is affixed to a container C that is one example of a to-be-conveyed object, and rewrites an image, as will be described in detail. It is noted that the "image" means visible information such as the contents of a load held by the container C, information of a transportation destination, the number of times of using the rewritable label RL or the like.

The "container C" is, for example, a box container for transportation. The "rewritable label RL" is a thermoreversible recording medium in which color is formed or color is erased due to a difference of heating and/or cooling processes, and includes a photothermal conversion material that absorbs laser light and produces heat. The rewritable label RL is affixed onto one side surface of the container C, for example. It is noted that the thermoreversible recording medium will be described later in detail.

Figure 1A:
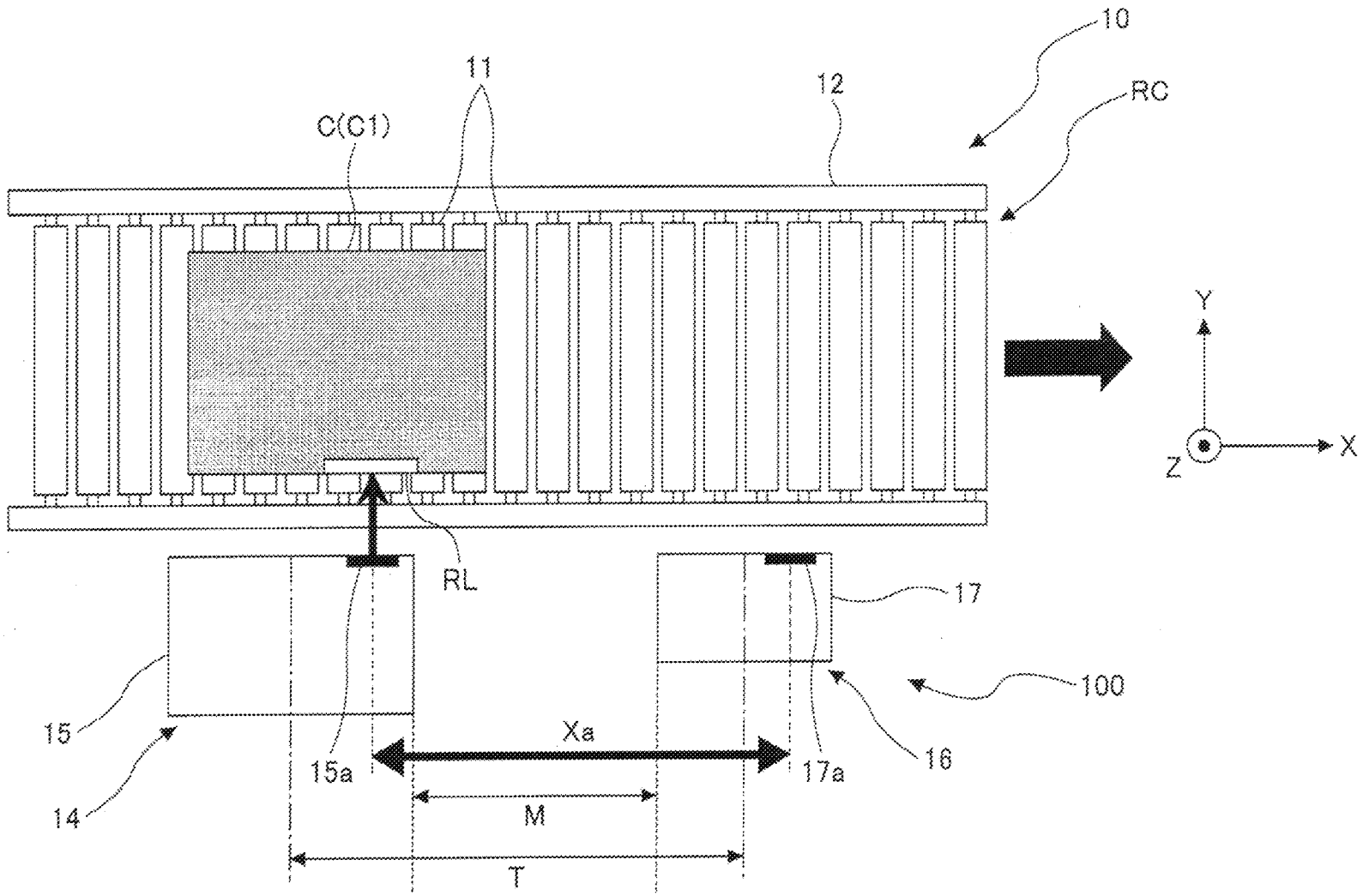
FIGS. 1A and 1B illustrate a laser rewriting apparatus (of a first layout) according to a first embodiment of the present invention.
Figure 1B:
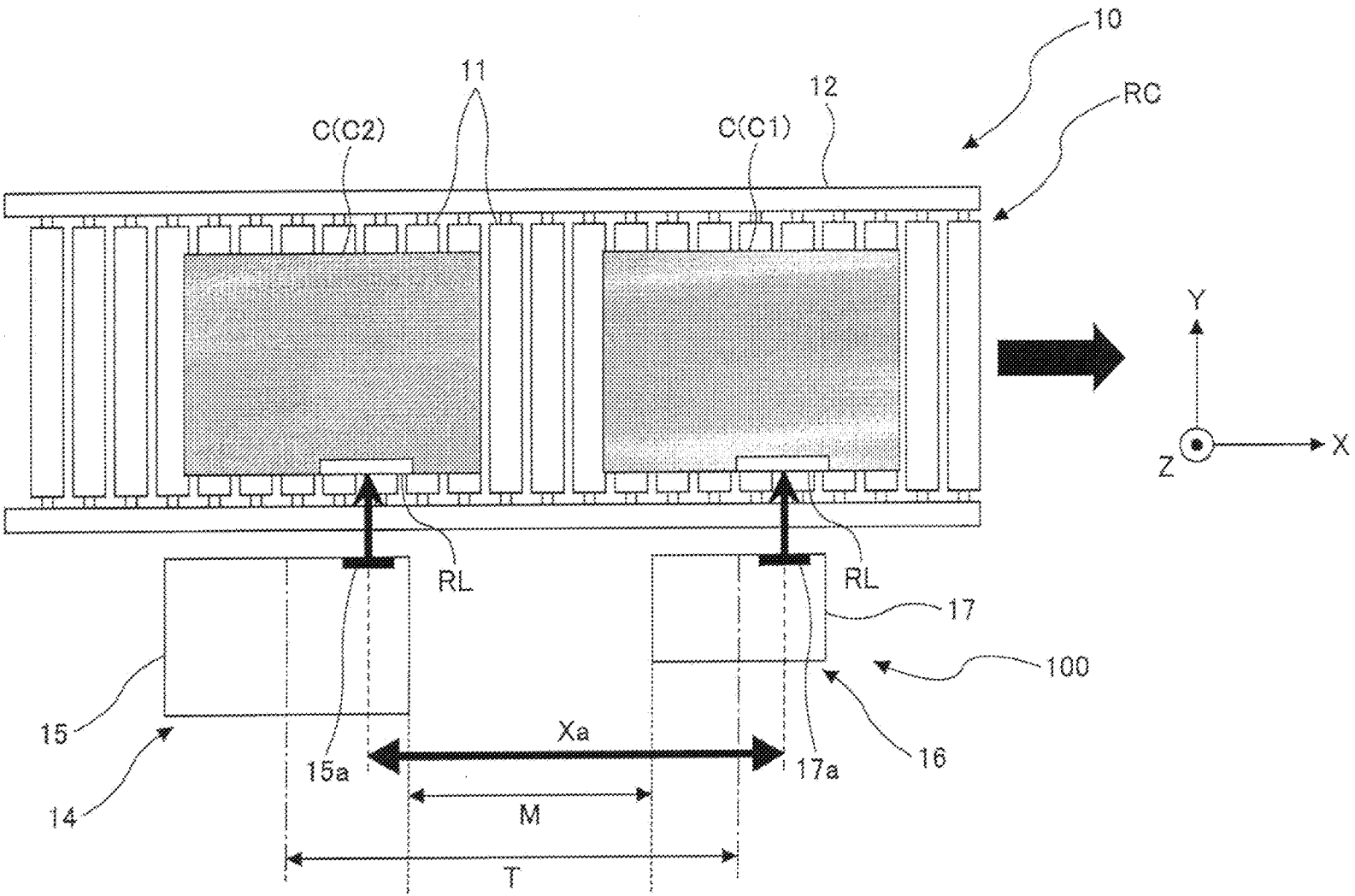

As shown in FIGS. 1A and 1B, the laser rewriting apparatus 100 includes an image erasing apparatus 14 and an image recording apparatus 16.

Figure 2A:
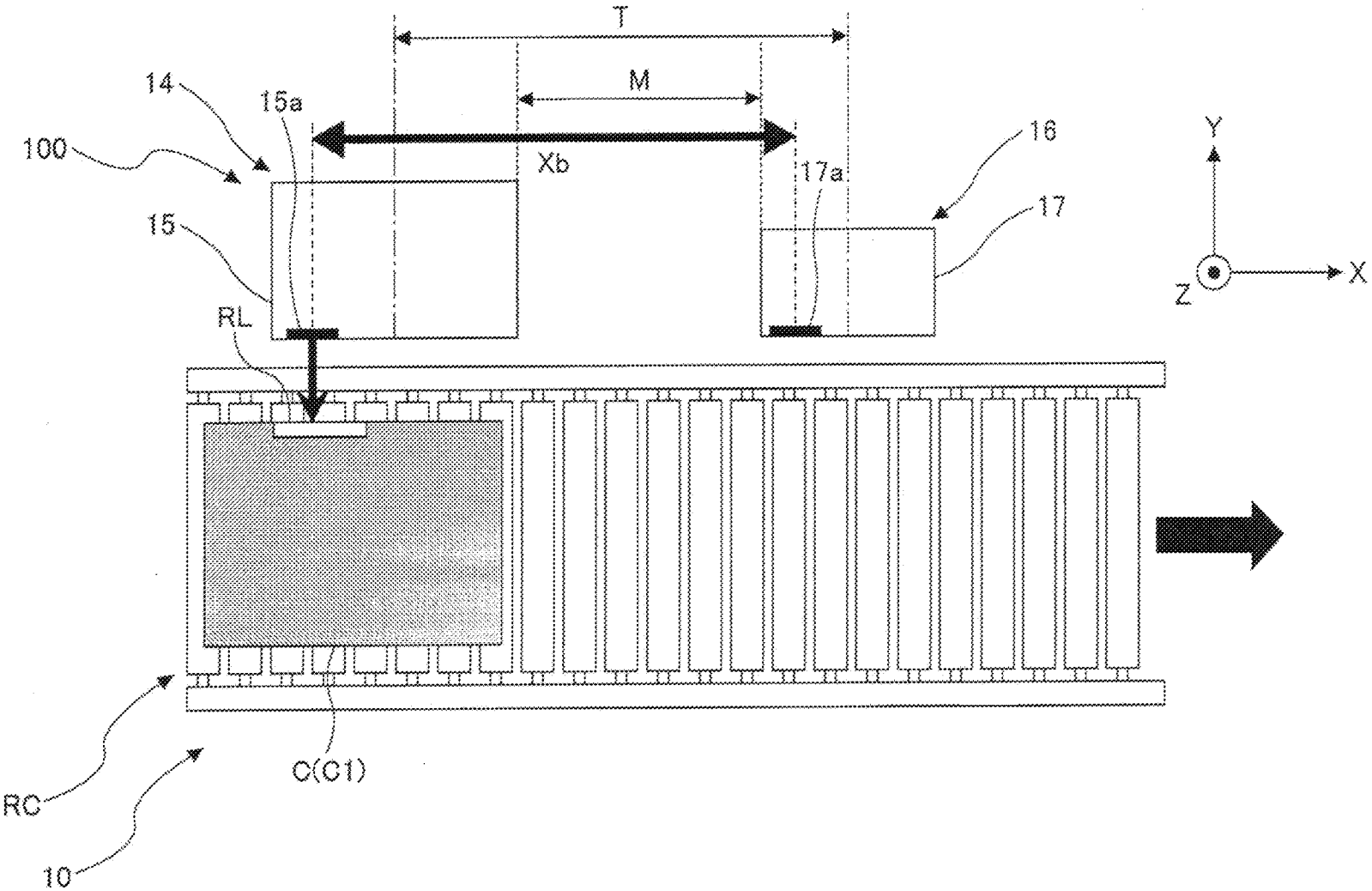
FIGS. 2A and 2B illustrate a laser rewriting apparatus (of a second layout) according to the first embodiment of the present invention.
Figure 2B:
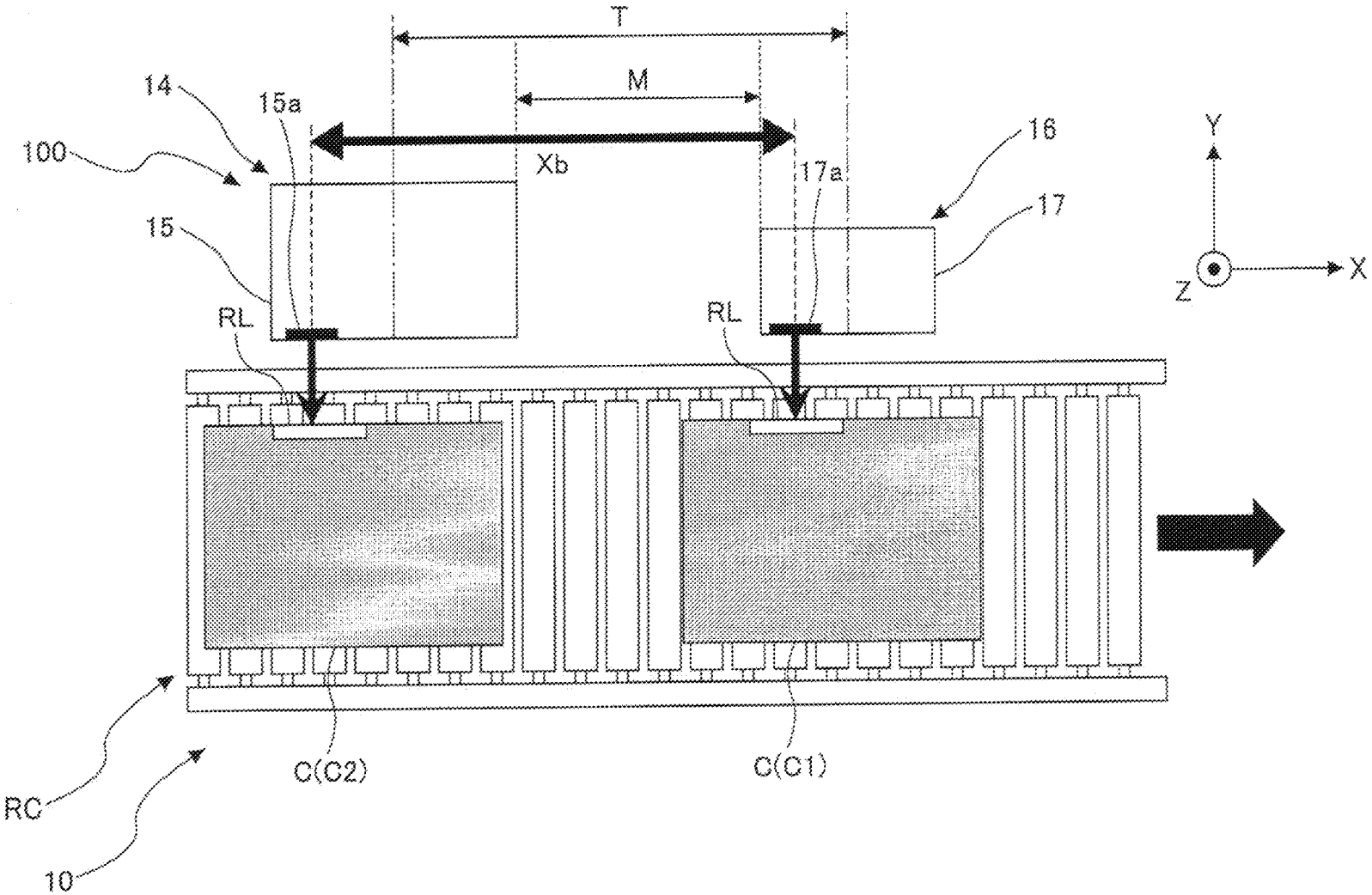

The image erasing apparatus 14 and the image recording apparatus 16 are arranged on a −Y side of a conveyer unit 10 that conveys the container C (see FIG. 1A) or on a +Y side of the conveyer unit (see FIG. 2A).

The conveyer unit 10 will now be described briefly. As one example, the conveyer unit 10 has a roller conveyer RC (conveyance path), a supporting base 12, a driving unit (not shown) and so forth.

The roller conveyer RC includes plural groups of rollers arranged in an X-axis direction. Each group of the plural groups of rollers includes plural rollers 11 (for example, 4 rollers 11) arranged in the X-axis direction at predetermined intervals and having axis directions of a Y-axis direction. The plural rollers 11 of each group are supported by the supporting base 12 in a state of synchronously rotatable on the Y-axis. The plural groups of rollers are controlled and driven independently (individually) by a main control unit (not shown) via the above-mentioned driving unit.

In the above-described configuration, the roller conveyer RC can convey or stop at least one container C on each group of rollers in the +X direction, and also can transfer the container C between the adjacent groups of rollers. Below, the direction (+X direction) of conveying the container C by the roller conveyer RC will be simply referred to as a conveyance direction, hereinafter.

It is noted that the conveyer unit 10 may have another type of a conveyance path such as a belt conveyer, for example, instead of the roller conveyer RC.

Below, the case will be described where the image erasing apparatus 14 and the image recording apparatus 16 are arranged on the −Y side of the conveyer unit 10 (also referred to as a "first layout", hereinafter). It is noted that the image erasing apparatus 14 and the image recording apparatus 16 described now are one example of an image erasing apparatuses and an image recording apparatuses using semiconductor lasers, and embodiments are not limited to this example.

Figure 3A:
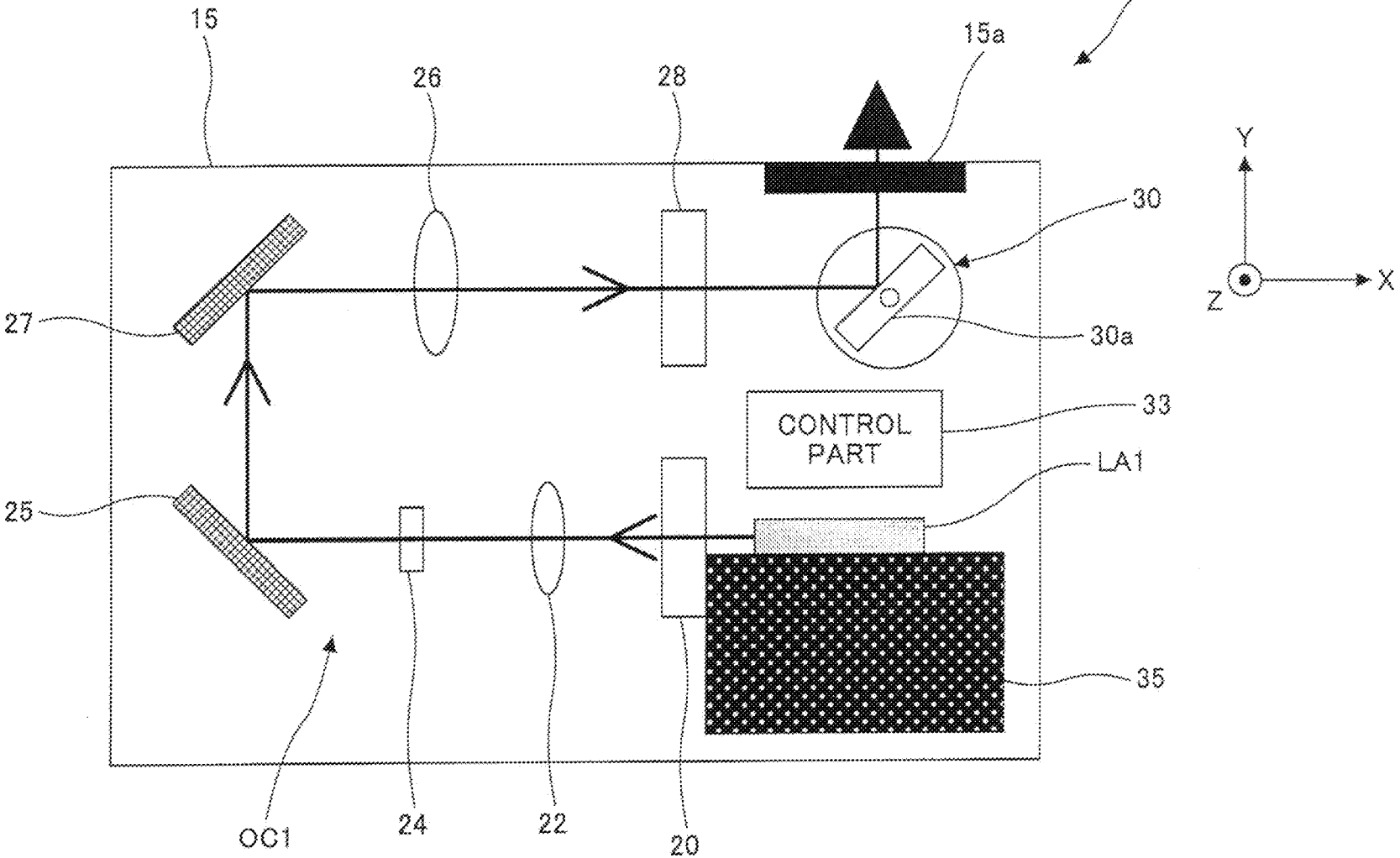
FIG. 3A shows a general configuration of an image erasing apparatus included in the laser rewriting apparatus.
Figure 3B:
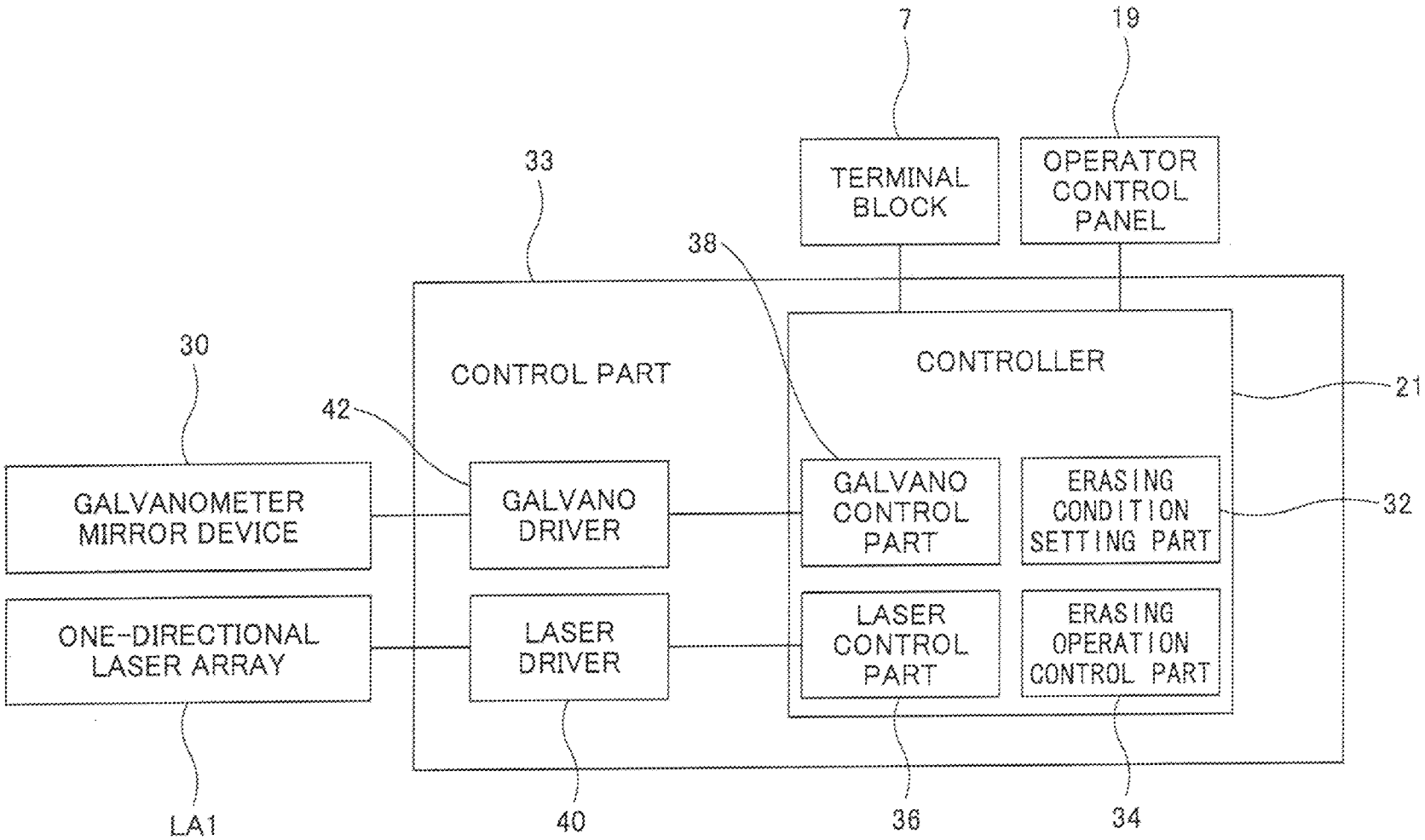
FIG. 3B is as a block diagram showing a configuration of a control part of the image erasing apparatus.

As shown in FIGS. 3A and 3B, the image erasing apparatus 14 includes a one-dimensional laser array LA1, an optical system OC1, a terminal block 7, an operator control panel 19, a control part 33, a cooling unit 35 and a housing 15 (see FIGS. 1A and 1B) having a rectangular parallelepiped shape, for example. The one-dimensional laser array LA1, the optical system OC1, the terminal block 5, the control part 33 and the cooling unit 25 are housed by the housing 15. The operator control panel 19 is provided on a side surface or the top surface of the housing 15, for example.

The one-dimensional laser array LA1 has, in one example, plural laser diodes (for example, 17 laser diodes) (semiconductor lasers) not shown arranged in a Z-axis direction (one-dimensional alignment). The distance between the laser diode of the +Z end and the laser diode of the −Z end in the Z-axis direction is set in 10 mm, for example. As one example, the one-dimensional laser array LA1 emits laser light having a line-shaped sectional shape (hereinafter, referred to as a "line-shaped beam") in the −X direction. The cooling unit 35 is, as one example, a heat sink that is positioned near the one-dimensional laser array LA1, and includes a fan for sending air to the heat sink, and/or the like.

The optical system OC1 includes, in one example, a first cylindrical lens 20, a first spherical lens 22, a micro lens array 24, a first reflecting mirror 25, a second reflecting mirror 27, a second spherical lens 26, a second cylindrical lens 28 and a galvanometer mirror device 30. Hereinafter, for the sake of convenience, the first cylindrical lens 20, first spherical lens 22, micro lens array 24, second spherical lens 26 and second cylindrical lens 28 will be together referred to as a "lens group".

As one example, the first cylindrical lens 20 is positioned on the optical path of the line-shaped beam emitted by the one-dimensional laser array LA1 (on the −X side of the one-dimensional laser array LA1) and slightly condenses the line-shaped beam in a width direction (Y) of the beam (in a direction (Y) parallel to a direction (Y) perpendicular to the direction (Z) of arranging the plural laser diodes). In this example, the small-sized first cylindrical lens 20 is positioned near the light emitting surface of the one-dimensional laser array LA1.

The first spherical lens 22 is, as one example, positioned on the optical path of the line-shaped beam after passing through the first cylindrical lens 20 (on the −X side of the first cylindrical lens 20), and collects the beam onto the micro lens array 24.

As one example, the micro lens array 24 is positioned on the optical path of the line-shaped beam after passing through the first spherical lens (on the −X side of the first spherical lens 22), and makes the light distribution uniform by uniformly diffusing the beam in the longitudinal direction (Z) (in the direction (Z) parallel to the direction (Z) of arranging the laser diodes).

The first reflecting mirror 25 is, as one example, positioned on the optical path of the line-shaped beam after passing through the micro lens array 24 (on the −X side of the micro lens array 24), and reflects the beam in the +Y direction.

The second reflecting mirror 27 is, as one example, positioned on the optical path of the line-shaped beam after being reflected by the first reflecting mirror 25 (on the +Y side of the first reflecting mirror 25), and reflects the beam in the +X direction.

The second spherical lens 26 is, as one example, positioned on the optical path of the line-shaped beam after being reflected by the second reflecting mirror 27 (on the +X side of the second reflecting mirror 27), and uniformly magnifies or condenses the beam in the longitudinal direction and the width direction.

The second cylindrical lens 28 is, as one example, positioned on the optical path of the line-shaped beam after passing through the second spherical lens 26 (on the +X side of the second spherical lens 26), and slightly condenses the beam in the width direction.

The galvanometer mirror device 30 is a device in which an oscillating mirror 30*a* that is rotatable in an oscillating manner and reflects the laser light is mounted to a galvanometer. In this example, as one example, the oscillating mirror 30*a* is rotatable around the Z-axis in an oscillating manner. The galvanometer mirror device 30 has an angle sensor (not shown) that detects the rotation angle of the oscillating mirror 30*a*.

As one example, the oscillating mirror 30*a* is positioned on the optical path of the line-shaped beam after passing through the second cylindrical lens 28 (on the +X side of the second cylindrical lens 28), reflects the beam while being rotated in the oscillating manner on the Z-axis (changes the reflecting direction), and deflects the beam approximately on the +Y side.

A light emitting hole (light emitting part) 15*a* is formed at an end of the X side of the side wall of the +Y side of the housing 15 for emitting the line-shaped beam deflected by the galvanometer mirror device 30 by allowing the deflected line-shaped beam to pass through. The light emitting hole 15*a* is blocked by a transparent or translucent member. Instead, it is also possible to provide a light shielding member to the housing 15 in such a manner that the light shielding member is movable between a blocking position of blocking the light emitting hole 15*a* and a retreating position of retreating the light shielding member from the blocking position. In this case, the light shielding member is moved to the blocking position when the laser light is not emitted. The light shielding member is moved to the retreating position when the laser light is emitted. The line-shaped beam deflected by the galvanometer mirror device 30 is emitted in such a manner that the line-shaped beam travels across above the roller conveyer RC at a height, for example, from several centimeters to tens of centimeters after passing through the light emitting hole 15*a*.

Thus, the energy density of the line-shaped beam emitted from the one-dimensional laser array LA1 is made uniform by the lens group, and also the line-shaped beam is magnified in the longitudinal direction (Z-axis direction), is deflected by the galvanometer mirror device 30 and is applied to the object that is at a position facing the light emitting hole 15*a* on the roller conveyer RC. As a result, the line-shaped beam is used to scan the object in the X-axis direction.

In the image erasing apparatus 14, in one example, as shown in FIG. 3A, the housing 15 is miniaturized as a result of the optical system OC1 that requires the relatively long path (optical path) being arranged in a "U" shape in a plan view, and also, the light emitting hole 15*a* being formed near the light emitting end of the optical system OC1, i.e., at the end of the +X side of the side wall of the +Y side of the housing 15.

Thus, the light emitting hole 15*a* is formed on the one side wall (the side wall on the +Y side) of the housing 15. Thus, in comparison to a case where, for example, a light emitting hole is formed at an area extending across the border between two adjacent side walls of the housing 15, it is possible to reduce degradation of strength of the housing 15.

The terminal block 7 has signal input terminals for inputting an erasing start signal, an interlock signal, an ambient temperature signal, an encoder signal and the like which are output from the main control unit (not shown); and signal output terminals for outputting an erasing perpetration completion signal, a during erasing signal, a trouble occurrence signal and the like to the main control unit.

The erasing start signal is a signal for the image erasing apparatus 14 to start an erasing operation. The interlock signal is a signal for stopping the erasing operation for an emergency reason. The ambient temperature signal is a signal for correcting the laser power (output) and the laser scanning speed according to the ambient temperature. The encoder signal is a signal for detecting the moving speed of the rewritable label RL (workpiece). The erasing preparation completion signal is a signal for indicating having become ready to be able to receive the erasing start signal. The during erasing signal is a signal for indicating carrying out the erasing operation. The trouble occurrence signal is a signal for indicating that a controller 21 has detected, for example, a trouble of emitting light of the one-dimensional laser array LA1, a trouble of operation of the galvanometer mirror device 30 or the like.

The operator control panel 19 is a user interface including simple indicators and operation switches. It is possible to select a menu and input a numerical value using the operator control panel 19. In this example, as one example, by using the operator control panel 19, it is possible to designate an erasing condition(s) such as the scanning length of laser light, the scanning speed of laser light, the scanning direction of laser light, the laser power, the erasing start delay time, the workpiece speed and the like.

The control part 33 includes the controller 21, a galvano driver 42 and a laser driver 40, as shown in FIG. 3B.

The controller 21 includes an erasing condition setting part 32, an erasing operation control part 34, a laser control part 36 and a galvano control part 38.

The erasing condition setting part 32 sets the erasing condition(s) such as the scanning length of laser light, the scanning speed of laser light, the scanning direction of laser light, the laser power, the erasing start delay time, the workpiece speed and the like, designated by a user using the operator control panel 19.

The erasing operation control part 34 processes the input signals from the terminal block 7, provides instructions to the laser control part 36 and the galvano control part 38, and also, generates the output signals to the terminal block 7.

The laser control part 36 converts an output value(s) of the lasers indicated by the erasing operation control part 34 into an analog voltage(s), outputs the analog voltage(s) to the laser driver 40, and also, generates a timing signal(s) for turning on and off the lasers.

The laser driver 40 is a circuit that generates a driving current(s) for the one-dimensional laser array LA1, and controls the laser power according to an instruction value(s) from the laser control part 36.

The galvano control part 38 generates an analog signal for rotating the oscillating mirror 30*a* of the galvanometer mirror device 30 in the oscillating manner at a designated speed from a scanning start position to a scanning end position indicated by the erasing operation control part 34, and outputs the analog signal to the galvano driver 42.

The galvano driver 42 is a circuit that controls the oscillating angle of the oscillating mirror 30*a* of the galvanometer mirror device 30 according to the instruction value from the galvano control part 38, compares the instruction value from the galvano control part 38 with the signal from the angle sensor that the galvanometer mirror device 30 has, and outputs such a driving signal to the galvanometer mirror device 30 to minimize the error therebetween.

The image recording apparatus 16 is positioned on the +X side (the conveyance-direction downstream side) of the image erasing apparatus 14 as can be seen from FIG. 1A.

It is preferable that distance M between the image erasing apparatus 14 and the image recording apparatus 16 in the X-axis direction is as short as possible from the point of view of miniaturizing the entirety of the laser rewriting apparatus 100. That is, it is preferable that the image erasing apparatus 14 and the image recording apparatus 16 are arranged to be close to one another. It is noted that "be close to" means that the distance M is, for example, less than or equal to 40 cm, preferably, less than or equal to 25 cm, and more preferably, less than or equal to 15 cm.

Figure 4A:
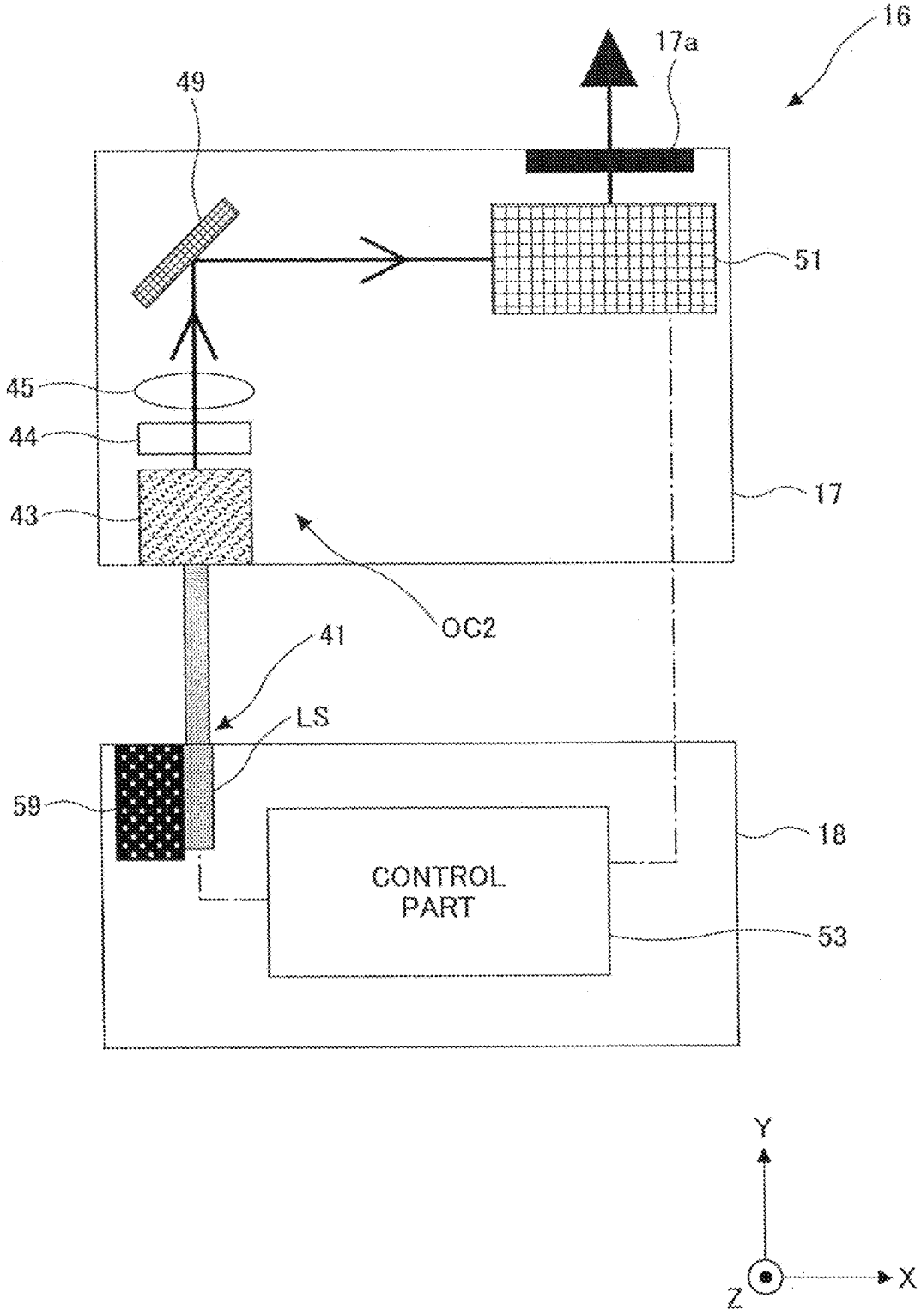
FIG. 4A shows a general configuration of an image recording apparatus included in the laser rewriting apparatus.

As shown in FIG. 4A, the image recording apparatus 16 includes a fiber coupling LD 41, an optical system OC2, a cooling unit 59, a control part 53, and a first housing 17 and a second housing 18 each of which has a rectangular parallelepiped shape, as one example.

In this example, as one example, the first housing 17 is positioned on the +Y side of the second housing 18. The optical system OC2 is contained in the first housing 17, and the cooling unit 59 and the control part 53 are contained in the second housing 18. It is noted that in FIGS. 1A through 2B, the second housing 18 and so forth are omitted.

The fiber coupling LD 41 includes a laser light source LS and a conversion optical system (not shown) for leading laser light from the laser light source LS to an optical fiber OF. As the laser light source LS, for example, a single laser, a laser array including plural lasers, a single emitter or the like may be used.

In the fiber coupling LD 41, as one example, the laser light source LS and the conversion optical system are housed by the second housing 18, and the optical fiber OF is extended from the second housing 18 to the first housing 17 and is connected with the incidence end of the optical system OC2. The cooling unit 59 includes, in one example, a heat sink (not shown) that is positioned close to the laser light source LS, a fan for sending air to the heat sink and/or the like.

By thus using the fiber coupling LD 41, it is possible to easily obtain laser light that can be easily condensed and is circular in cross-section (hereinafter, referred to as a "circular beam"). Further, it is possible to install the first housing 17 near the roller conveyer RC and install the second housing 18 at a position far from the roller conveyer RC. Thus, the installation can be easily carried out even in a case where the installation space around the conveyance path is narrow.

In one example, the optical system OC2 includes a collimator lens unit 43, a focal position correction unit 44, a condensing lens 45 (for example, a spherical lens), a reflecting mirror 49 and a galvanometer mirror system 51.

The collimator lens unit 43 includes, in one example, plural collimator lenses spaced in the optical-axis direction, and the incidence end thereof (the incident end of the optical system OC2) is connected with the optical fiber OF. The collimator lens unit 43 parallelizes the circular beam from the fiber coupling LD 41 and emits it in the +Y direction.

The focal position correction unit 44 is, in one example, positioned on the optical path of the circular beam after passing through the collimator lens unit 43 (on the +Y side of the collimator lens unit 43), and includes a focal position correction lens (not shown) and a moving mechanism (not shown) that moves the focal position correction lens in the optical-axis direction. By moving the focal position correction lens by the moving mechanism in the optical-axis direction, the focal position correction unit 44 optically controls the focal length of the circular beam, and emits the circular beam. It is noted that it is preferable to provide a distance sensor (not shown) that detects the distance between a light emitting hole (light emitting part) 17*a* of the image recording apparatus 16 and the rewritable label RL, and control the moving mechanism based on the detection result of the distance sensor.

The condensing lens 45 is, as one example, positioned on the optical path of the circular beam after passing through the focal position correction unit 44 (on the +Y side of the focal position correction unit 44), converts the circular beam into convergent light, and emits the circular beam.

The reflecting mirror 49 is, in one example, positioned on the optical path of the circular beam after passing through the condensing lens 45 (on the +Y side of the condensing lens 45) and reflects the circular beam in the +X direction.

Figure 4B:
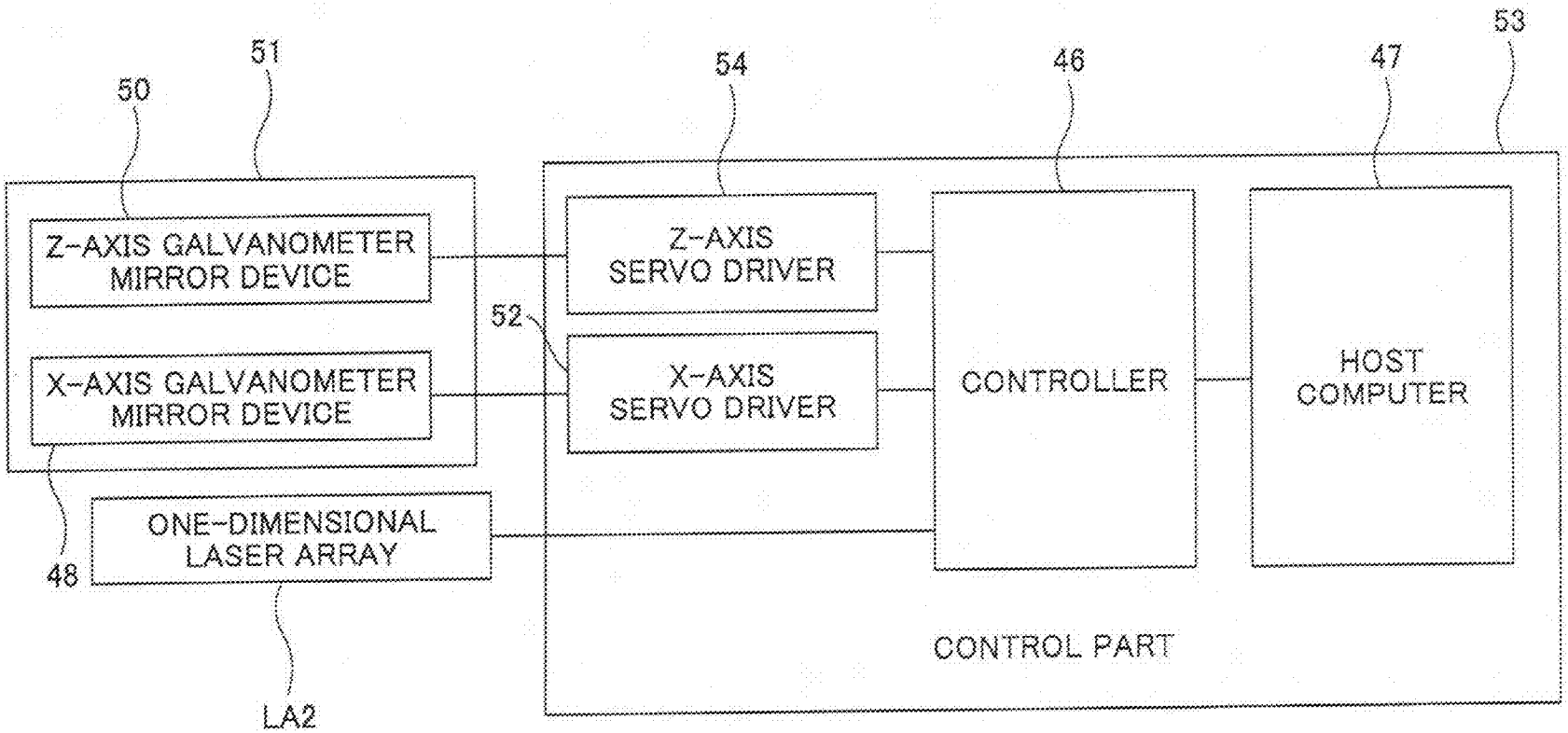
FIG. 4B is as a block diagram showing a configuration of a control part of the image recording apparatus.

As shown in FIG. 4B, the galvanometer mirror system 51 includes an X-axis galvanometer mirror device 48 and a Z-axis galvanometer mirror device 50.

The X-axis galvanometer mirror device 48 has the same configuration as the above-described galvanometer mirror device 30 except that its oscillating mirror (not shown) is rotated in an oscillating manner on the Y-axis. The X-axis galvanometer mirror device 48 is, in one example, positioned on the optical path of the circular beam after being reflected by the reflecting mirror 49 (on the +X side of the reflecting mirror 49) and deflects the circular beam approximately on the −Z side (or the +Z side).

The Z-axis galvanometer mirror device 50 has the same configuration as the above-described galvanometer mirror device 30 except that its oscillating mirror (not shown) is rotated in an oscillating manner on the X-axis. The Z-axis galvanometer mirror device 50 is, in one example, positioned on the optical path of the circular beam after being deflected by the X-axis galvanometer mirror device 48 (on the −Z side (or the +Z side) of the oscillating mirror of the X-axis galvanometer mirror device 48) and deflects the circular beam approximately on the +Y side.

The light emitting hole (light emitting part) 17*a* is formed on the side wall of the +Y side of the first housing 17 for allowing the laser light deflected by the Z-axis galvanometer mirror device 50 to pass through. In one example, the light emitting hole 17*a* is blocked by a transparent or translucent member. The circular beam having passed through the light emitting hole 17*a* travels across above the roller conveyer RC at a height, for example, from several centimeters to tens of centimeters.

Thus, the circular beam emitted from the fiber coupling LD 41 is led to the galvanometer mirror system 51 through the collimator lens unit 43, the focal position correction unit 44, the condensing lens 45 and the reflecting mirror 49, is deflected by the X-axis and Z-axis galvanometer mirror devices 48 and 50, in sequence, and is applied to the object that is at a position facing the light emitting hole 17*a* on the roller conveyer RC. As a result, the optical spot is used to scan the object in the two-dimensional directions of the X-axis and Z-axis.

In order to record an image on the rewritable label RL in a fine recording line width, it is necessary to reduce the beam diameter of the circular beam to be incident on the galvanometer mirror system 50 as much as possible. It is noted that in a case where the beam diameter is large, it is necessary to increase the size of the oscillating mirrors of the galvanometer mirror devices. In this case, operations of the mirrors may not be carried out precisely, and the recording accuracy may be degraded.

In order to reduce the beam diameter of the circular beam to be incident on the galvanometer mirror system 50 as much as possible, it is necessary to increase the optical path length from the focal position correction unit 44 to the galvanometer mirror device 51 in the optical system OC2.

In the image recording apparatus 16, as one example, the optical system OC2 is arranged in an "L" shape in a plan view, and also, the light emitting hole 17*a* is formed near the light emitting end of the optical system OC2, i.e., at the end of the +X side of the side wall of the +Y side of the first housing 17. Thus, the first housing 17 is miniaturized and the above-mentioned optical path length is increased as much as possible.

Thus, the light emitting hole 17*a* is formed on the one side wall (the side wall on the +Y side) of the first housing 17. Thus, in comparison to a case where, for example, a light emitting hole is formed at an area extending across the border between two adjacent side walls of the first housing 17, it is possible to reduce degradation of the strength of the first housing 17.

The control part 53 has a controller 46, a host computer 47, an X-axis servo driver 52 and a Z-axis servo driver 54, as shown in FIG. 4B.

Based on image information that is output by the host computer 47, the controller 46 generates rendering data formed of line segments, controls the positions of the oscillating mirrors of the X-axis and Z-axis galvanometer mirror devices 48 and 50, timing of emitting the laser light and the light emitting power, and records (forms) an image on the recording target. In this case, in one example, an image such as characters/letters, numerals, a figure or a bar code is recorded in a recording line width of approximately 0.25 mm.

The controller 46 controls the X-axis galvanometer mirror device 48 through the X-axis servo driver 52, and also, controls the Z-axis galvanometer mirror device 50 through the Z-axis servo driver 54.

The X-axis servo driver 52 is a circuit that controls the position of the oscillating mirror of the X-axis galvanometer mirror device 48 according to the instruction value from the controller 46, compares the signal of the angular sensor of the X-axis galvanometer mirror device 48 with the instruction value from the controller 46, and outputs the driving signal to minimize the error therebetween to the X-axis galvanometer mirror device 48.

Similarly, the Z-axis servo driver 54 is a circuit that controls the position of the oscillating mirror of the Z-axis galvanometer mirror device 50 according to the instruction value from the controller 46, compares the signal of the angular sensor of the Z-axis galvanometer mirror device 50 with the instruction value from the controller 46, and outputs the driving signal to minimize the error therebetween to the Z-axis galvanometer mirror device 50.

For the image erasing apparatus 14 and the image recording apparatus 16, it is also possible to suitably select the lasers such as, for example, solid-state lasers, fiber lasers, $CO_2$ lasers or the like, other than the semiconductor lasers, depending on the intended purpose. In a case of using lasers other than semiconductor lasers in the image erasing apparatus 14 and the image recording apparatus 16, it is also possible to provide optical systems other than those of the image erasing apparatus 14 and the image recording apparatus 16 described above. Also in this case, it is preferable to arrange the optical systems in the image erasing apparatus 14 and the image recording apparatus 16 in an "U" shape in a plan view and a "L" shape in a plan view, respectively, the same as in the image erasing apparatus 14 and the image recording apparatus 16 described above, for the purpose of miniaturizing the housings, and also, increasing the optical path lengths as much as possible.

According to the embodiment, as described above, semiconductor lasers are used in the image erasing apparatus 14 and the image recording apparatus 16 from a point of view of a wide range of wavelength selectivity, being able to miniaturize the apparatuses since the lasers themselves are small and being able to reduce the cost.

As the wavelength of laser light emitted by the lasers of the image erasing apparatus 14 and the image recording apparatus 16, 700 nm or greater is preferable; 720 nm or greater is more preferable; and 750 nm or greater is still more preferable. As the upper limit of the wavelength of the laser light, it is possible to suitably select it depending on the intended purpose, but 1500 nm or less is preferable; 1300 or less is more preferable; and 1200 nm or less is still more preferable.

When the wavelength of the laser light is shorter than 700 nm, in a visible light region a problem of reduction of contrast at a time of recording an image on the thermoreversible recording medium and/or a problem of the thermoreversible recording medium (rewritable label RL) being colored may occur. In an ultraviolet light region of further shorter wavelengths, degradation of the thermoreversible recording medium may easily occur.

For the photothermal conversion material to be added to the thermoreversible recording medium, a high decomposition temperature is required for the purpose of ensuring durability against repetitive image processing. In a case where organic coloring matter is used in the photothermal conversion material, it may be difficult to obtain photothermal conversion material that has the high decomposition temperature and also the long absorption wavelength. Thus, as the wavelength of the laser light, 1500 nm or less is preferable.

The wavelength of laser light emitted by a $CO_2$ laser is 10.6 μm in a far-infrared region, and a medium surface absorbs the laser light even when no additive for absorbing the laser light and generating heat is added. Since the additive may also somewhat absorb visible light even when laser light having the wavelength of a near-infrared region is used, it is possible to avoid degradation of image contrast by using a $CO_2$ laser for which the additive is not needed.

Thus, the case (first layout) has been described where the image erasing apparatus 14 and the image recording apparatus 16 are positioned on the −Y side of the conveyer unit 10. However, a case where the image erasing apparatus 14 and the image recording apparatus 16 are positioned on the +Y side of the conveyer unit 10 (also referred to as a second layout) is approximately the same except that the direction of emitting the laser light is reverse (see FIG. 2A).

The laser rewriting apparatus 100 rewrites an image by carrying out the erasing operation by the image erasing apparatus 14 when the container C on which the rewritable label RL on which the image is recorded is affixed has been conveyed to the +Y side (or the −Y side) of the image erasing apparatus 14 by the roller conveyer RC; and carrying out the recording operation by the image recording apparatus 16 when the same container C has been conveyed to the +Y side (or the −Y side) of the image recording apparatus 16 by the roller conveyer RC.

In more detail, the image erasing apparatus 14 emits laser light and erases the image recorded on the rewritable label RL when the rewritable label RL affixed on the container C has come to be at a predetermined position of the +Y side (or the −Y side) of the image erasing apparatus 14, i.e., the position directly confronting the light emitting hole 15*a* (hereinafter, simply referred to as an erasing position). It is noted that, in one example, the image erasing apparatus 14 has a sensor (not shown) to detect the container C that is at the erasing position. The main control unit stops the container C after decelerating it when having received a detection signal from the sensor. It is noted that a stopper may be provided to the conveyer unit 10 for stopping the container C at the erasing position precisely and rapidly and also for causing vibration of the conveyer unit 10 to less influence the container C. In this case, it is possible to control movement of the container C when it is stopped, and thus, it is possible to carry out the erasing operation to the rewritable label RL with high accuracy.

The image recording apparatus 16 emits laser light and records a new image on the rewritable label RL when the rewritable label RL affixed on the container C has come to be at a predetermined position of the +Y side (or the −Y side) of the image recording apparatus 16, i.e., the position directly confronting the light emitting hole 17*a* (hereinafter, simply referred to as a "recording position"). It is noted that, in one example, the image recording apparatus 16 has a sensor (not shown) to detect the container C that is at the recording position. The main control unit stops the container C after decelerating it when having received a detection signal from the sensor. Also for the image recording apparatus 16, the same as for the image erasing apparatus 14, a stopper may be provided to the conveyer unit 10 for preventing movement of the container C from influencing the recording operation.

As described above, in the first layout, as shown in FIG. 1A, the light emitting hole 15*a* of the image erasing apparatus 14 is formed at the end of the +X side of the side wall of the +Y side of the housing 15, and the light emitting hole 17*a* of the image recording apparatus 16 is formed at the end of the +X side of the side wall of the +Y side of the first housing 17. In the second layout, as shown in FIG. 2A, the light emitting hole 15*a* of the image erasing apparatus 14 is formed at the end of the −X side of the side wall of the −Y side of the housing 15, and the light emitting hole 17*a* of the image recording apparatus 16 is formed at the end of the −X side of the side wall of the −Y side of the first housing 17. By thus providing the light emitting hole at the end of the X-axis direction of the housing, it is possible to easily increase the optical path of the optical system in the housing in comparison to a case where the light emitting hole is formed at the center of the X-axis direction of the housing (in a case where the center of the light emitting hole is at the center of the X-axis direction of the housing).

That is, according to the first and second layouts, with respect to the conveyance direction (the X-axis direction), the two light emitting holes 15*a* and 17*a* are at the ends of the same side of the image erasing apparatus 14 and the image recording apparatus 17. "The two light emitting holes 15*a* and 17*a* are at the ends of the same sides" means that the X positions (the positions with respect to the X-axis direction) of the centers of the two light emitting holes 15*a* and 17*a* are on the +X sides of the X positions of the centers of the corresponding housings, respectively, or on the −X sides of the X positions of the centers of the corresponding housings, respectively.

In this case, the distance Xa (see FIG. 1A) between the respective centers of the two light emitting holes 15*a* and 17*a* with respect to the X-axis direction in the first layout is approximately equal to the distance T (hereinafter, referred to as a "housing center-to-center distance" T) between the center of the housing 15 and the center of the first housing 17 with respect to the X-axis direction. Also, the distance Xb (see FIG. 2A) between the respective centers of the two light emitting holes 15*a* and 17*a* with respect to the X-axis direction in the second layout is approximately equal to the housing center-to-center distance T. That is, |Xa−T| is small, and |Xb−T| is small. Hereinafter, for the sake of convenience, the distance between the centers of the two light emitting holes 15*a* and 17*a* with respect to the X-axis direction (the conveyance direction) will be referred to as a "light emitting hole center-to-center distance".

Figure 5A:
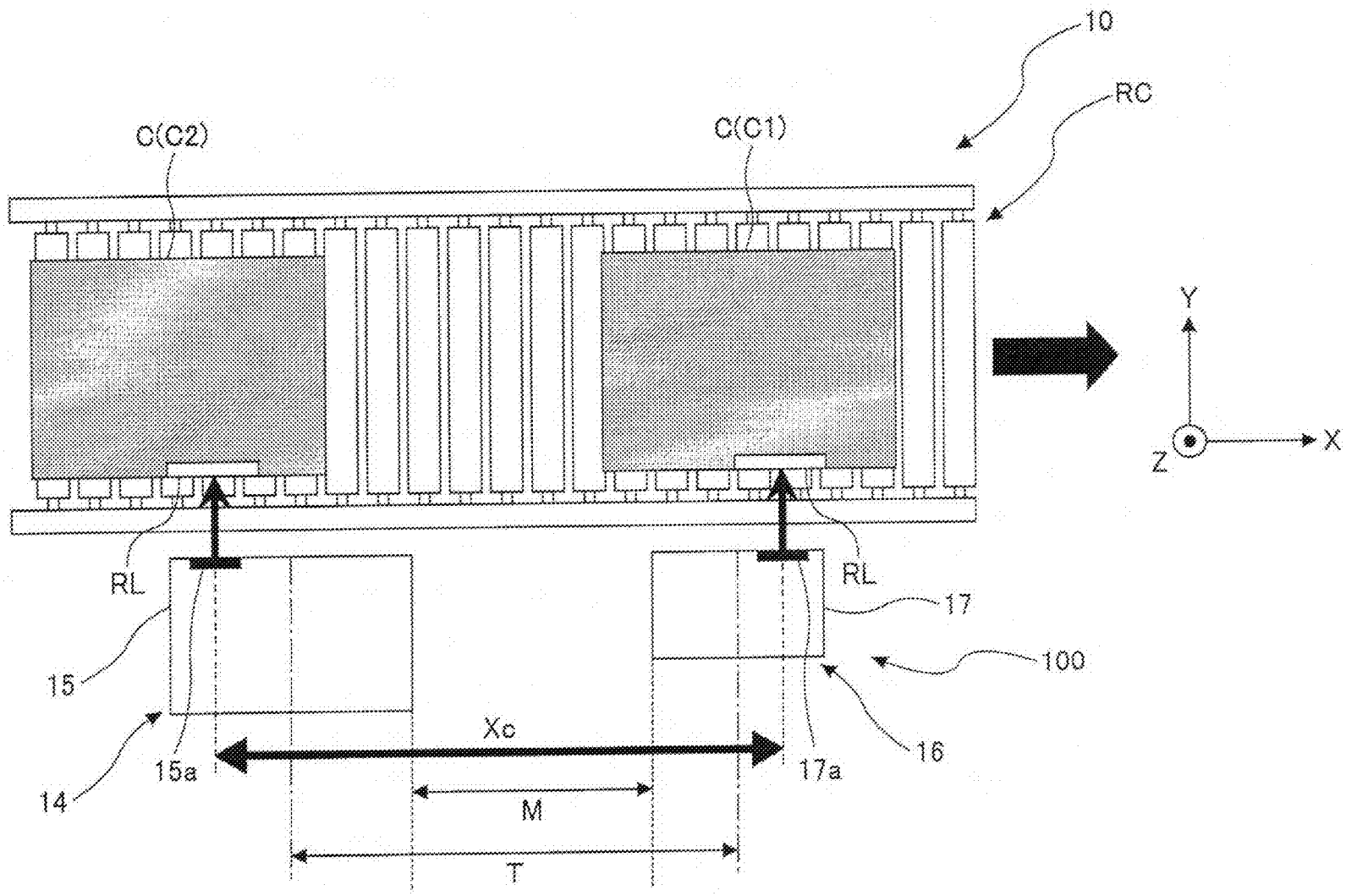
FIGS. 5A and 5B illustrate a laser rewriting apparatus of a comparison example.
Figure 5B:
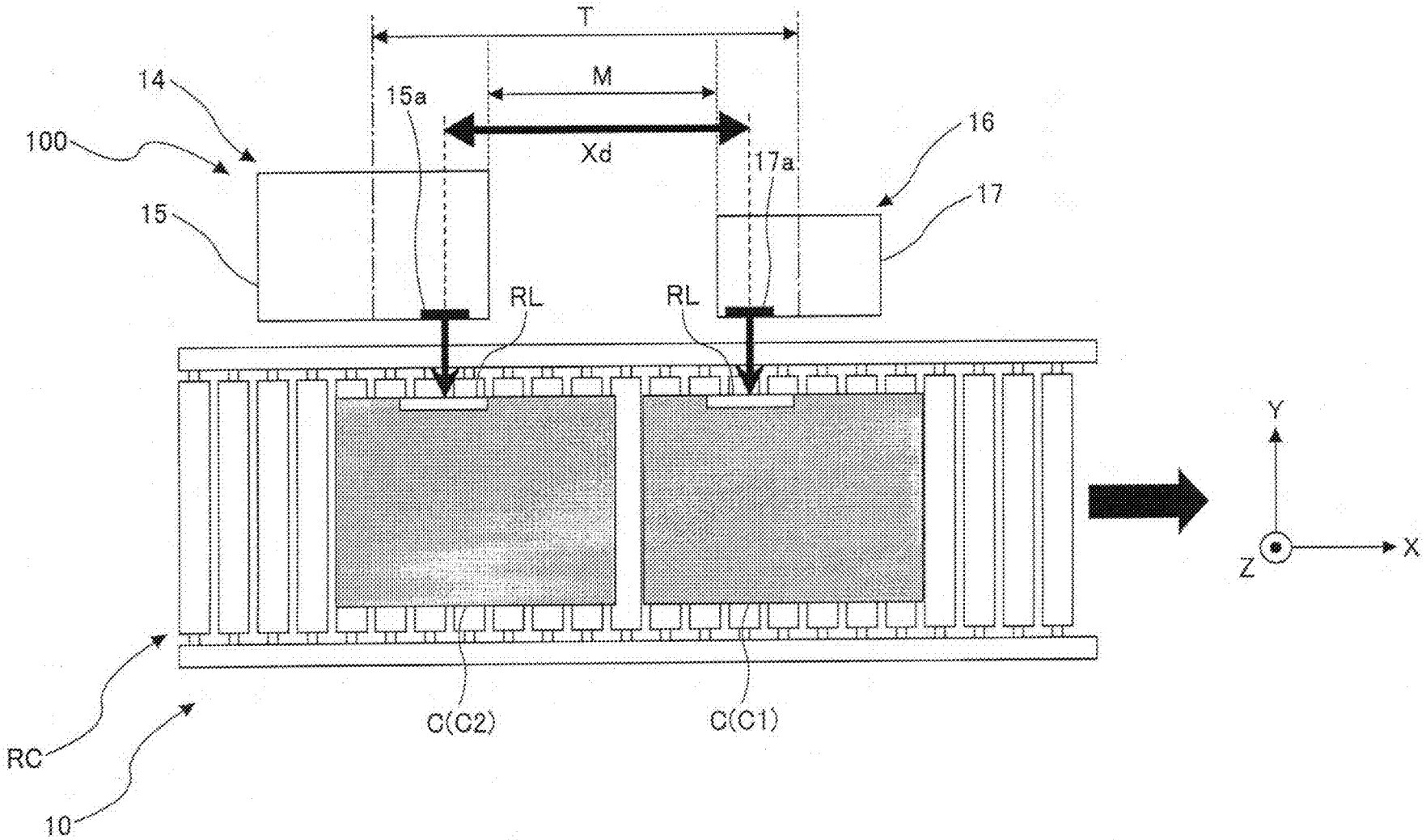

In contrast thereto, assuming that the two light emitting holes 15*a* and 17*a* are at the ends of the reverse sides of the image erasing apparatus 14 and the image reading apparatus with respect to the conveyance direction (X-axis direction), the light emitting hole center-to-center distance Xc in the first layout is remarkably longer than the housing center-to-center distance T (see FIG. 5A). Similarly, the light emitting hole center-to-center distance Xd in the second layout is remarkably shorter than the housing center-to-center distance T (see FIG. 5B). It is noted that "the two light emitting holes 15*a* and 17*a* are at the ends of the reverse sides" means that the X position of the center of one of the two light emitting holes 15*a* and 17*a* is on the +X side of the X position of the center of the corresponding housing, and the X position of the center the other is on the −X side of the X position of the center of the corresponding housing.

Next, one example of operations of the laser rewriting apparatus 100 will be described. It is noted that the operations that will now be described are controlled by the main control unit in an overall manner. In a memory (not shown) included in the main control unit, information of an image(s) to be recorded on the rewritable label RL, i.e., the contents of the load currently contained in the container C, information of transportation destination, the number of times of using the rewritable label RL and the like are stored.

On the upstream side (the −X side) of the erasing position on the roller conveyer RC, for example, the plural containers C in which the loads are contained and on which the rewritable labels RL are affixed on their one side walls, respectively, are arranged in the X-axis direction. It is noted that in the figures, because of the restrictions of showing in the figures, only a central part of the roller conveyer RC with respect to the X-axis direction is shown.

Hereinafter, for the sake of convenience, the plural containers C will be referred to as a "first container" C1, . . . and an "N-th container" Cn, respectively, which are arranged in the stated order from the +X side to the −X side.

It is noted that these containers C are placed on the roller conveyer RC in such a manner that the side walls on which the rewritable labels RL are affixed, respectively, can face the respective light emitting holes 15*a* and 17*a* of the image erasing apparatus 14 and the image recording apparatus 16.

First, a worker operates an operator control panel (not shown) of the main control unit, and transmits a conveyance start signal to the main control unit.

The main control unit that has thus received the conveyance start signal individually controls the plural groups of rollers of the roller conveyer RC, and conveys the N containers C at short intervals by the roller conveyer RC.

Then, the first container C1 is stopped at the erasing position, and the erasing operation is carried out by the image erasing apparatus 14 on the rewritable label RL of the first container C1 (see FIGS. 1A and 2A).

After the erasing operation is thus finished, the first container C1 is conveyed to and is stopped at the recording position. The second container C2 is conveyed to and is stopped at the erasing position. Then, the recording operation on the rewritable label RL of the first container C1 and the erasing operation on the rewritable label RL of the second container C2 are carried out in parallel (see FIGS. 1B and 2B).

After the recording operation is thus finished, the first container C1 is conveyed to a subsequent process (for example, a transportation preparation process). After the erasing operation is thus finished, the second container C2 is conveyed to and is stopped at the recording position. The third container C3 (not shown) is conveyed to and is stopped at the erasing position. Then, the recording operation on the rewritable label RL of the second container C2 and the erasing operation on the rewritable label RL of the third container C3 are carried out in parallel Thus, the erasing operations and the recording operations are carried out on the rewritable labels RL of the respective containers C, and the images are rewritten.

From a point of view of carrying out the rewriting of the images on the rewritable labels RL rapidly and increasing the throughput, it is preferable to reduce the period of time (hereinafter, referred to as a "container C conveyance time") required for conveying the container C from the erasing position to the recording position as much as possible. That is, it is preferable to reduce the light emitting hole center-to-center distance as much as possible. However, if the light emitting hole center-to-center distance is too short, there may be a case where the erasing operation and the recording operation cannot be carried out in parallel. It is noted that specific examples of the "a case where the erasing operation and the recording operation cannot be carried out in parallel" are, for example, a case where, depending on the size of the container C, it is not possible to position one container C at the recording position and another container C at the erasing position at the same time; a case where the laser light emitted by the image erasing apparatus 14 and the laser light emitted by the image recording apparatus 16 interfere; and so forth, may be cited.

In order to carry out the erasing operation and the recording operation in parallel and also reduce degradation of throughput, it is preferable that the light emitting hole center-to-center distance is set to a moderate length (for example, on the order of the housing center-to-center distance T).

The above-described laser rewriting apparatus 100 according to the first embodiment is positioned on the +Y side or the −Y side of the conveyer unit 10 that conveys the container C in the +X direction on which the rewritable label RL is affixed.

The laser rewriting apparatus 100 includes the image erasing apparatus 14 that emits laser light and erases an image recorded on the rewritable label RL; and the image recording apparatus 16 that is positioned on the +X side (the conveyance-direction downstream side) of the image erasing apparatus 14 and emits laser light and records a new image on the rewritable label RL from which the image has been erased by the image erasing apparatus 14. The image erasing apparatus 14 and the image recording apparatus 16 have the light emitting holes (light emitting parts) 15*a* and 17*a* from which the laser light is emitted at ends of the same sides of the conveyance direction (X-axis direction).

In this case, in the laser rewriting apparatus 100, the light emitting hole center-to-center distance is approximately equal to the housing center-to-center distance whether the laser rewriting apparatus 100 is positioned on the +Y side or the −Y sided of the conveyer unit 10 (whether any one of the first and second layouts is employed). Thus, it is possible to avoid degradation of throughput and carry out the erasing operation and the recording operation in parallel.

As a result, the laser rewriting apparatus 100 can sufficiently exert the apparatus performance whether it is positioned on the +Y side or the −Y side of the conveyer unit 10.

In contrast thereto, assuming that the image erasing apparatus 14 and the image recording apparatus 16 have the light emitting holes 15*a* and 17*a* at ends of different sides of the conveyance direction, the light emitting hole center-to-center distance becomes remarkably longer than the housing center-to-center distance T (the container C conveyance time becomes longer) and the throughput may be degraded in a case where one of the first and second layouts is employed. Further, it may not be possible to carry out the erasing operation and the recording operation in parallel since the light emitting hole center-to-center distance becomes remarkably shorter in a case where the other of the first and second layouts is employed. Thus, whether the first or second layout is employed, the apparatus performance may not sufficiently be exerted.

Further, according to the laser rewriting apparatus 100, the light emitting hole center-to-center distance is approximately equal to the housing center-to-center distance T whether the first or second layout is employed. Thus, even when the distance M between the image erasing apparatus 14 and the image recording apparatus 16 is reduced, there is a high possibility that the erasing operation and the recording operation can be carried out in parallel. That is, the laser rewriting apparatus 100 can sufficiently exert the apparatus performance while miniaturization of the entirety of the apparatus can be achieved, whether the first or second layout is employed.

Thus, according to the laser rewriting apparatus 100, the apparatus performance can be ensured whether the first or the second layout is employed. Thus, it is possible to suitably determine whether to position the laser rewriting apparatus 100 on the +Y side or the −Y side of the conveyer unit 10 depending on the apparatus's installation environment (for example, whether the sufficient installation space can be obtained, how easy or difficult the installation can be carried out, how easy or difficult the maintenance can be carried out, and/or the like).

Next, a second embodiment of the present invention will be described based on FIGS. 6A and 6B. In the second embodiment, the same reference numerals/signs are given to members and so forth having configurations the same as or similar to those of the above-mentioned first embodiment, the duplicate description will be omitted, and points different from the first embodiment will be mainly described.

Figure 6A:
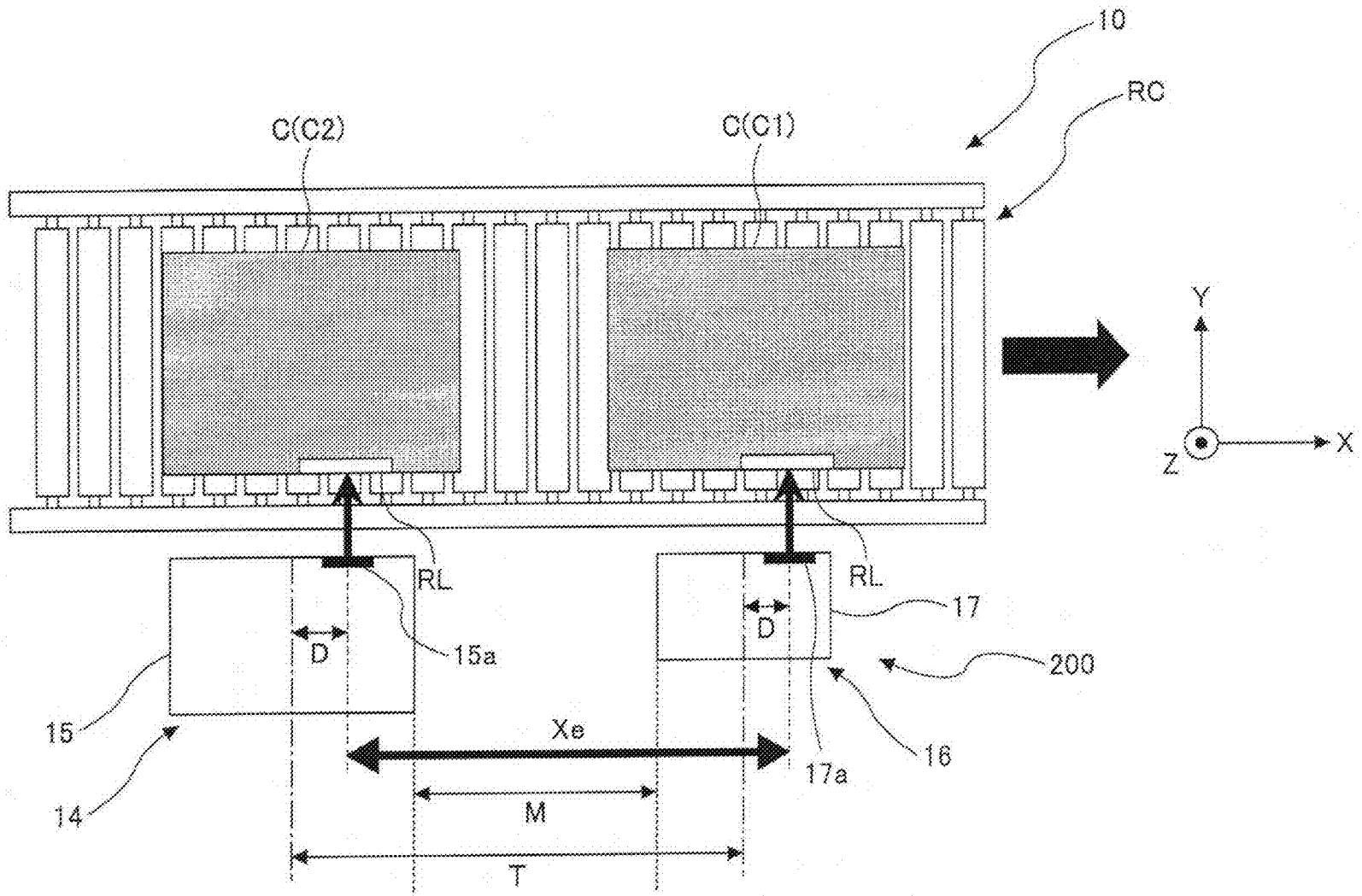
FIGS. 6A and 6B illustrate a laser rewriting apparatus according to a second embodiment of the present invention.
Figure 6B:
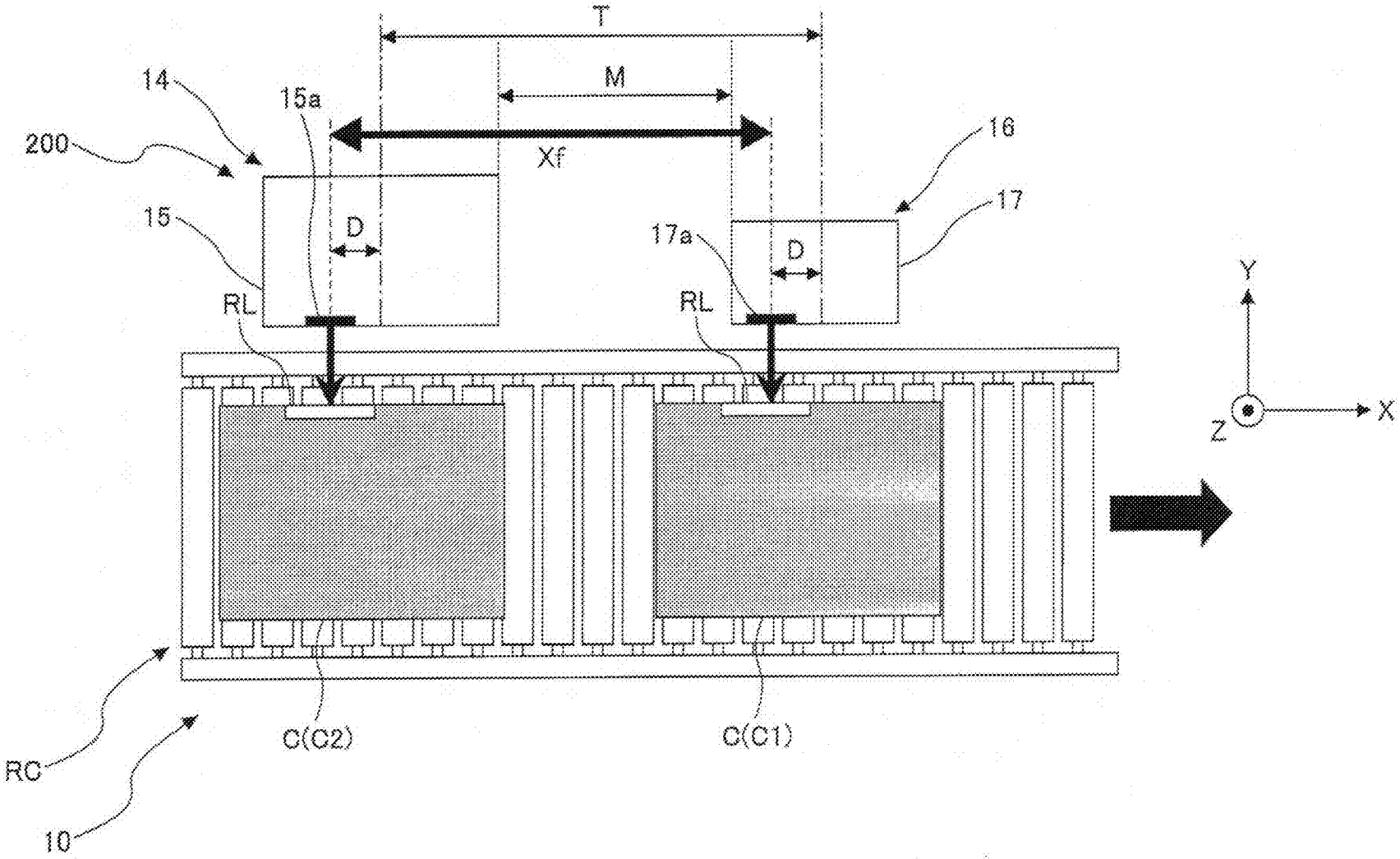

In a laser rewriting apparatus 200 according to the second embodiment, as shown in FIGS. 6A and 6B, the light emitting hole 15*a* of the image erasing apparatus 14 and the light emitting hole 17*a* of the image recording apparatus 16 are formed at the ends of the same side (the +X side or the −X side) of the conveyance direction, the same as the first embodiment.

In addition, according to the second embodiment, the distance with respect to the X-axis direction (conveyance direction) between the center of the image erasing apparatus 14 and the center of the light emitting hole 15*a* of the image erasing apparatus 14 and the distance with respect to the X-axis direction (conveyance direction) between the center of the image recording apparatus 16 and the center of the light emitting hole 17*a* of the image recording apparatus 16 are set to the same distance D. In this case, the light emitting hole center-to-center distance Xe in the first layout becomes equal to the housing center-to-center distance T (see FIG. 6A). Similarly, the light emitting hole center-to-center distance Xf in the second layout becomes equal to the housing center-to-center distance T (see FIG. 6B).

According to the second embodiment, the light emitting hole center-to-center distances in the first and second layouts are equal and the container C conveyance times in the first and second layouts are equal accordingly. Thus, just the same throughput can be achieved by any one of the first and second layouts.

Next, based on FIG. 7, a third embodiment will be described. In the third embodiment, the same reference numerals/signs are given to members and so forth having configurations the same as or similar to those of the above-mentioned first and second embodiments, the duplicate description will be omitted, and points different from the first and second embodiments will be mainly described.

Figure 7:
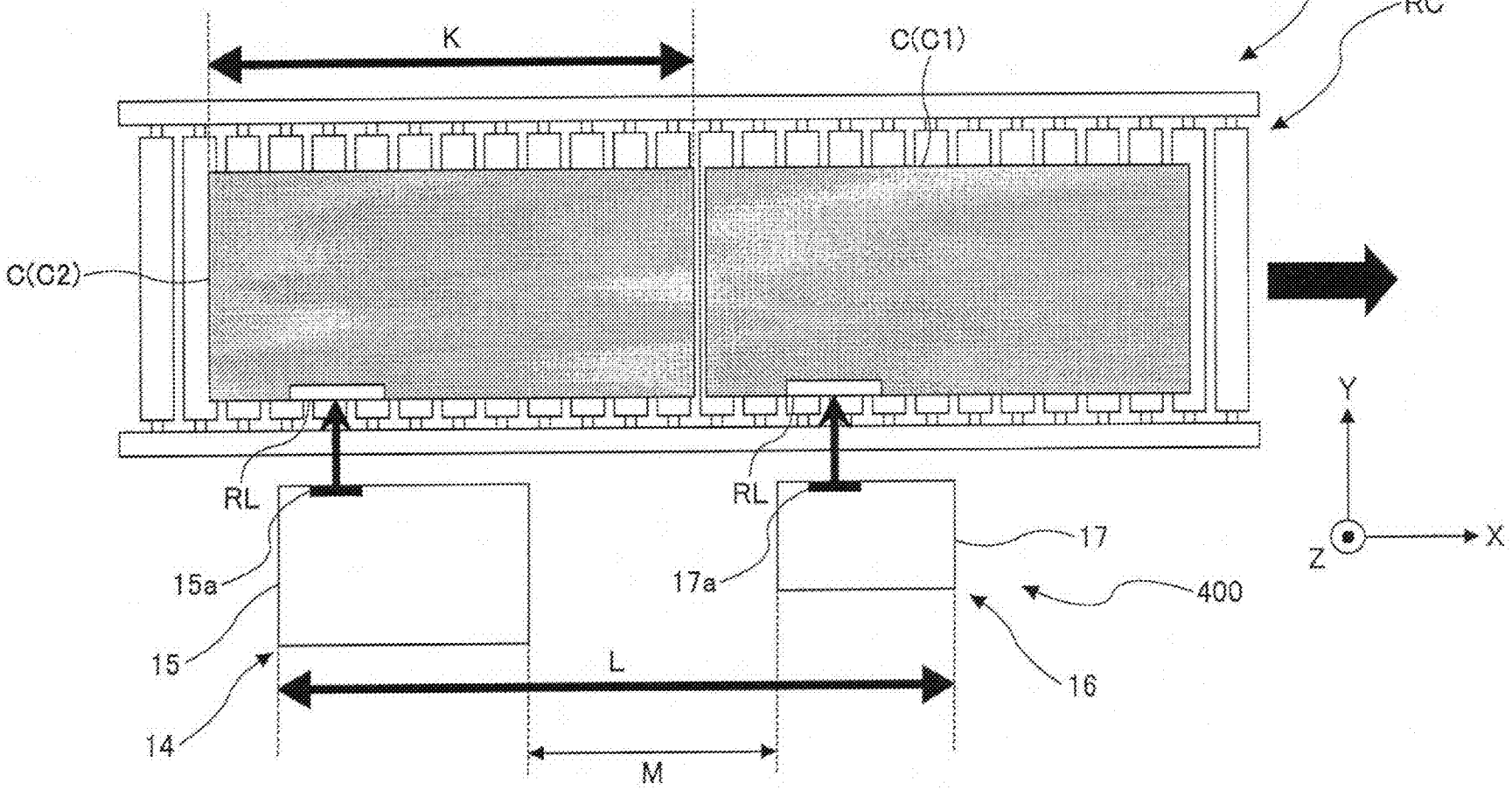
FIG. 7 illustrates a laser rewriting apparatus according to a third embodiment of the present invention.

According to the third embodiment, as shown in FIG. 7, in addition to the first or second embodiment, the distance L (hereinafter, referred to as a side-to-side distance L) with respect to the X-axis direction between the side surface of the −X side (the side surface on the conveyance-direction upstream side) of the housing 15 of the image erasing apparatus 14 and the side surface of the +X side (the side surface on the conveyance-direction downstream side) of the first housing 17 of the image recording apparatus 16 is set to be shorter than twice the length K of the X-axis direction of the container C ($L<2K$).

In this case, when the plural containers C having the same size are conveyed successively by the roller conveyer RC, the number of the containers C at the positions on the roller conveyer RC between the side surface of the −X side of the housing 15 and the side surface of the +X side of the first housing 17 (hereinafter, referred to as the side-to-side positions on the roller conveyer RC) is one or two. It is noted that in a case where the plural containers C having the different sizes are successively conveyed in a mixed state, the container C having the maximum length with respect to the X-axis direction is regarded as the basis of the length K.

At this time, the number of the containers C at each of the erasing position and the recording position is 0 or 1. In this case, the same as the above-mentioned first and second embodiments, after the erasing operation for the rewritable label RL of the container C is finished, the container C is conveyed to the recording position from the erasing position, and the recording operation is carried out.

Figure 8:
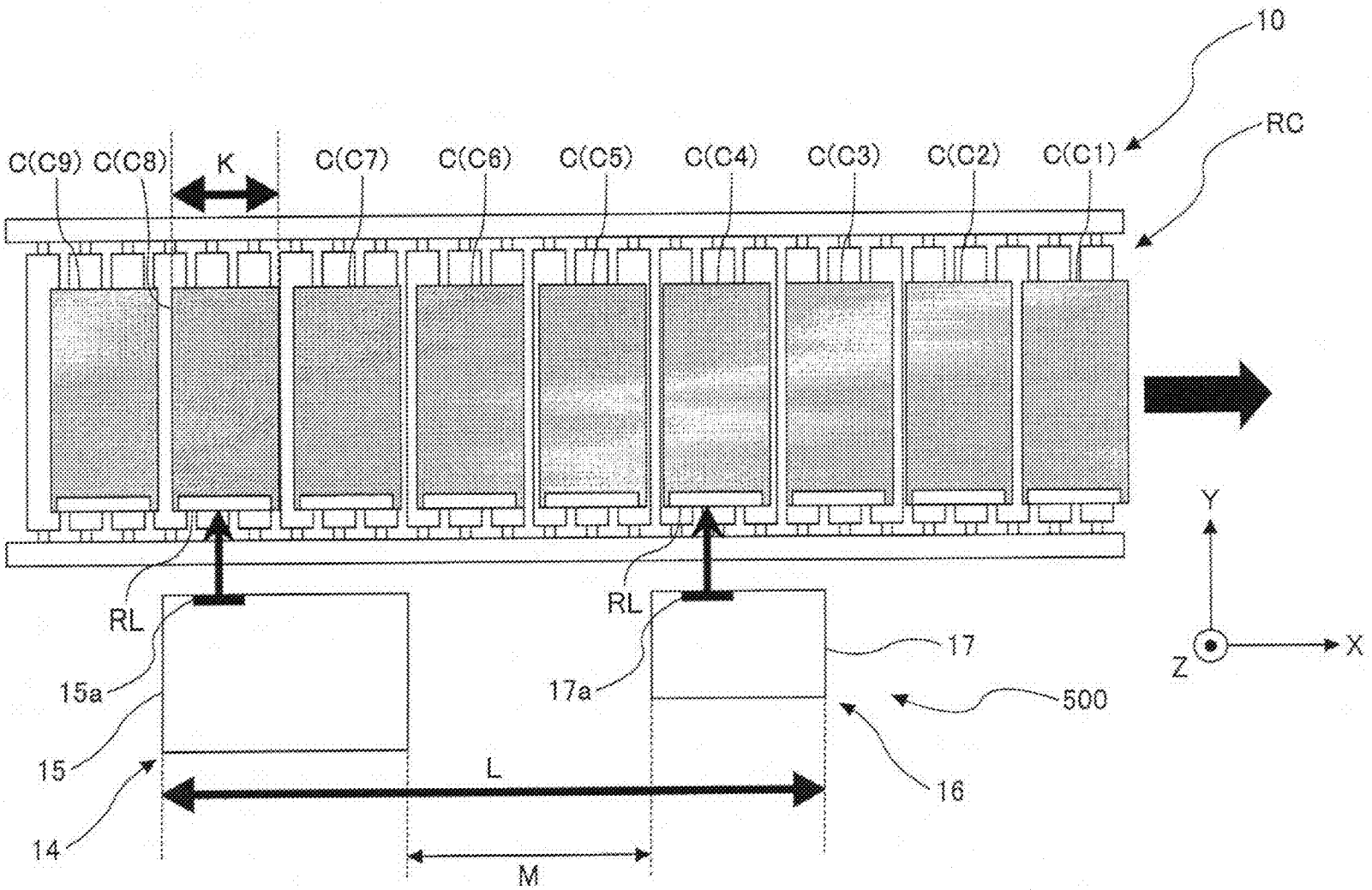
FIG. 8 illustrates a laser rewriting apparatus of a comparison example.

On the other hand, assuming that the side-to-side distance L is greater than or equal to twice the length K of the X-axis direction of the container C ($L \geq 2K$), in a case where the plural containers C having the same size are conveyed successively by the roller conveyer RC, the number of containers C at the side-to-side positions on the roller conveyer RC is two or more. In this case, when the ratio of the side-to-side distance L with respect to the length K of the X-axis direction of the container C is increased, at least one container C can be inserted between the erasing position and the recording position, as shown in FIG. 8. As a result, the distance of conveying the container C that is between the erasing position and the recording position to the recording position is shorter than the distance between the erasing position and the recording position, and this state is preferable from a point of view of throughput. However, when the side-to-side distance L is increased for the purpose of increasing the ratio of the side-to-side distance L with respect to the distance K of the X-axis direction of the container C, the size of the apparatus is increased. When the length K of the X-axis direction of the container C is reduced for the same purpose, the capacity of the container C may become insufficient.

Thus, according to the third embodiment, as described above, the side-to-side distance L is set to be shorter than twice the length K of the X-axis direction of the container C ($L<2K$). As a result, it is possible to sufficiently ensure the capacity of the container C while miniaturizing the apparatus.

Next, based on FIG. 9, a fourth embodiment will be described. In the fourth embodiment, the same reference numerals/signs are given to members and so forth having configurations the same as or similar to those of the above-mentioned first, second and third embodiments, the duplicate description will be omitted, and points different from the first, second and third embodiments will be mainly described.

Figure 9:
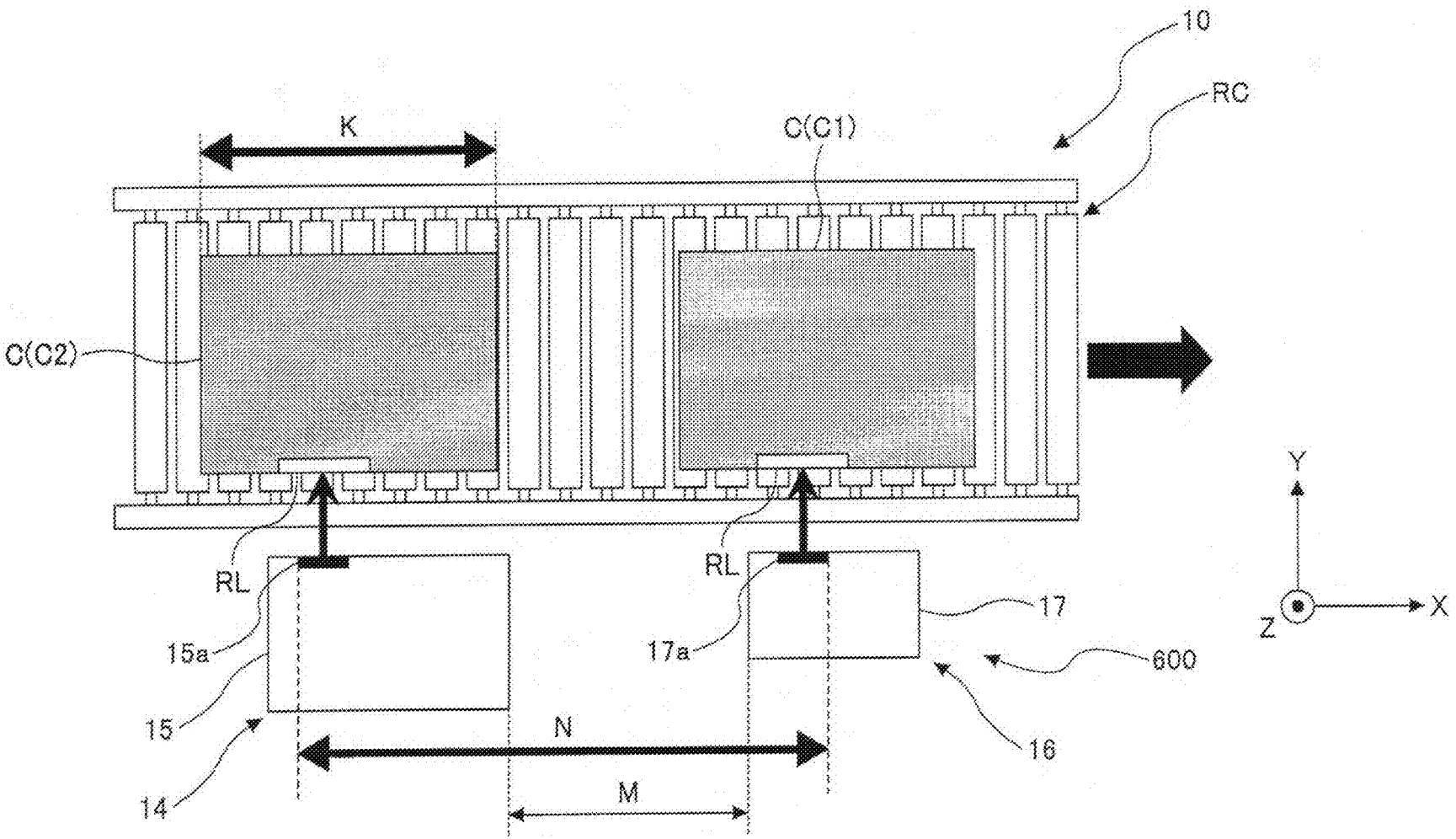
FIG. 9 illustrates a laser rewriting apparatus according to a fourth embodiment of the present invention.

According to the fourth embodiment, as shown in FIG. 9, in addition to the first, second or third embodiment, the distance N (hereinafter, referred to as a "light emitting hole maximum distance" N) between the edge of the −X side (the edge on the conveyance-direction upstream side) of the light emitting hole 15*a* of the image erasing apparatus 14 and the edge of the +X side (the edge on the conveyance-direction downstream side) of the light emitting hole 17*a* of the image recording apparatus 16 is set to be longer than the length K of the X-axis direction ($N>K$).

As a conveyance container (i.e., the above-mentioned container C) to be conveyed by the roller conveyer RC, various things may be used. Specifically, conveyance containers of various materials such as corrugated cardboards, polypropylene (PP), stainless steel and so forth, conveyance containers on which companies' names or the like are printed, conveyance containers which are marked by a felt-tip pen, conveyance containers to which pigment or dye has adhered, conveyance containers in which pigment or dye has been kneaded into the container materials for the purpose of color coding (distinguishing by using different colors), and the like, may be cited.

When laser light is applied to such a conveyance container, the laser may be absorbed depending on the material and/or the pigment/dye and heat may be generated. When laser light is repetitively applied to such a conveyance container, the conveyance container may be deformed, damaged or the like, and the period of time (the lifetime of the conveyance container) for which the conveyance container can be used repetitively may be shortened.

Assuming that the light emitting hole maximum distance N is less than or equal to the length K of the X-axis direction of the container C ($N \leq K$), the single container C can face the two light emitting holes 15*a* and 17*a* at the same time. Thus, the laser light may be erroneously emitted to the container C on which the rewritable label RL is affixed from the image recording apparatus 16 during the erasing operation on this rewritable label RL by the image erasing apparatus 14; or the laser light may be erroneously emitted to the container C on which the rewritable label RL is affixed by the image erasing apparatus 14 during the recording operation on this rewritable label RL by the image recording apparatus 16. Further, if the erasing operation and the recording operation are not carried out in parallel and are carried out separately for the purpose of avoiding the erroneous light emission, the throughput may be degraded.

Below, the rewritable label RL used in the above-mentioned first, second, third and fourth embodiments, i.e., the thermoreversible recording medium, will be described.

The image erasing and image forming mechanism in the thermoreversible recording medium includes a way of the color tone being reversibly changed by heat. This way is realized by a leuco dye and a reversible developer (hereinafter also referred to as a "developer") and the color tone is changed between a transparent state and a color formed state reversibly.

Figure 10A:
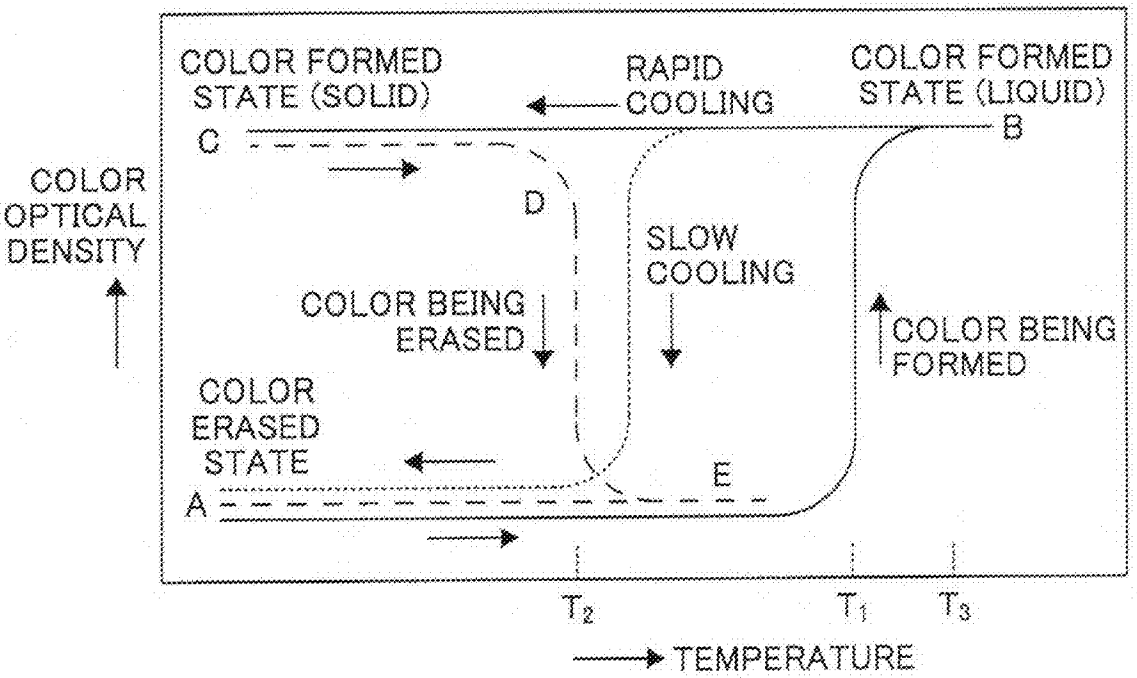
FIG. 10A is a graph showing color forming and color erasing characteristics of a thermoreversible recording medium on which image rewriting is carried out by the laser rewriting apparatus.
Figure 10B:
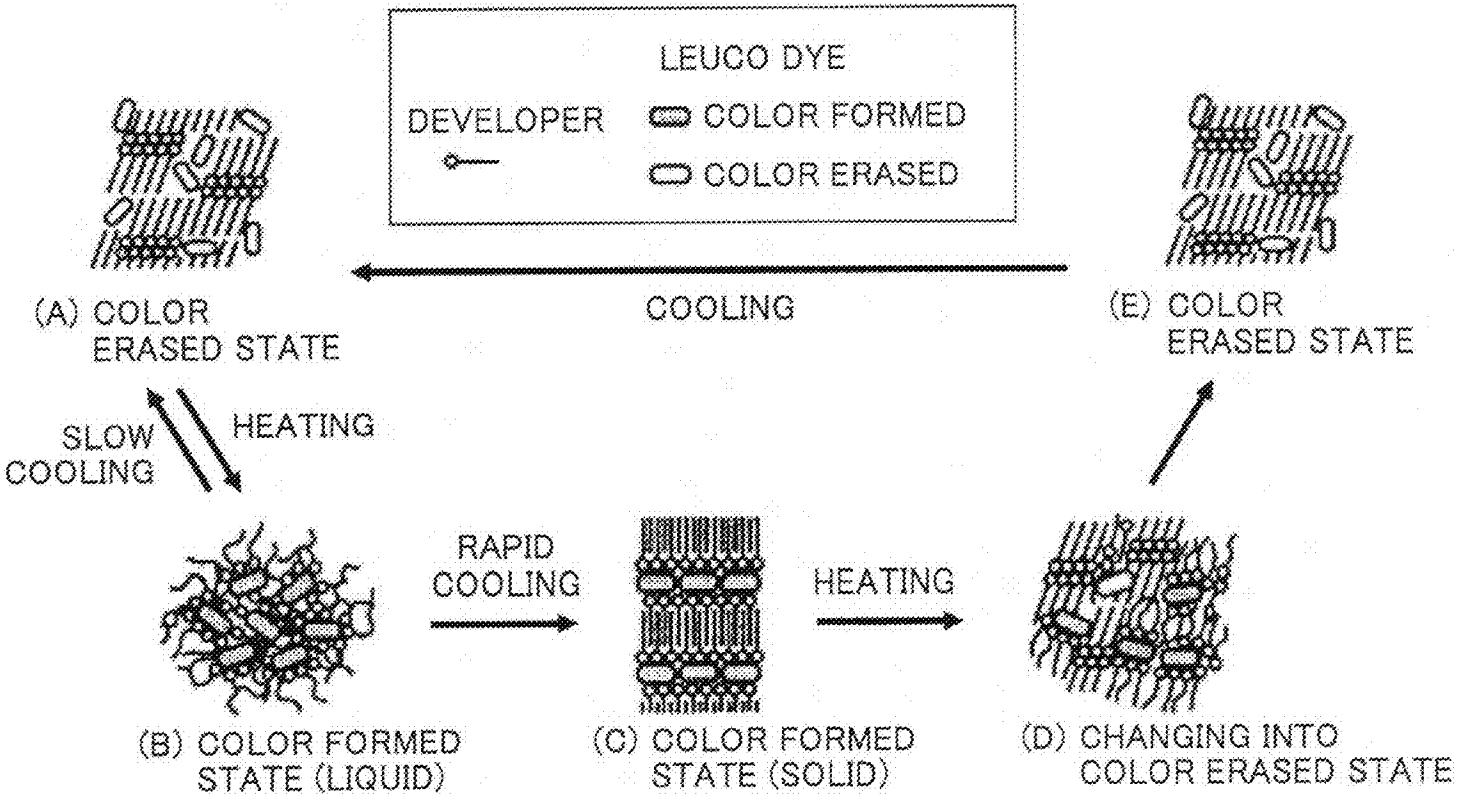
FIG. 10B shows a mechanism of color forming and color erasing of the thermoreversible recording medium.

FIG. 10A shows an example of the temperature-color optical density change curve of a thermoreversible recording medium which has a thermoreversible recording layer including a leuco dye and a developer in a resin. FIG. 10B shows the color forming and erasing mechanism of the thermoreversible recording medium which is reversibly changed by heat between a transparent state and a color formed state.

When the temperature of the recording layer in the color erased state (A) is increased, the leuco dye and the developer melt and mix at a melting temperature $T_1$, thereby color is formed, and thus the recording layer enter a melted and color formed state (B). When the recording layer in the melted and color formed state (B) is rapidly cooled, it is possible to reduce the temperature of the recording layer to the room temperature while keeping the color formed state. Thus, the color formed state is stabilized, and a fixed color formed state (C) is obtained. Whether this color formed state is obtained depends on the cooling rate from the temperature of the melted state. In the case of slow cooling, the color is erased in the cooling process. As a result, the recording layer returns to the color erased state (A) the same as the initial state, or comes into a state where the density is lower than the density of the color formed state (C) produced by the rapid cooling.

On the other hand, when the recording layer in the color formed state (C) is heated again, the color is erased at the temperature $T_2$ lower than the color formed temperature (from D to E). When the temperature of the recording layer in this state is reduced, it returns to the color erased state (A) the same as the initial state.

The color formed state (C) obtained by the rapidly cooling from the melted state is a state where the leuco dye and the developer are mixed together in a state where catalysis of the molecules thereof can occur. This state may be a solid state in many cases. This state is a state where the melted mixture (the above-mentioned color formed mixture) of the leuco dye and the developer crystallizes, and thus color formed state is maintained. It is considered that the color formed state is stabilized as a result of this structure being formed. On the other hand, the color erased state (A) is a state where the leuco dye and the developer are phase-separated. It is considered that this state is a state where molecules of at least one of the compounds gather to form a domain or crystallize, and thus is a stabilized state where the leuco dye and the developer are separated from each other as a result of the aggregation or the crystallization. In many cases, complete color fading is obtained from the phase separation of the leuco dye and the developer and the crystallization of the developer in this manner.

It is noted that in each of both the color erasure from the melted state by the slow cooling and the color erasure from the color formed state by the temperature increase shown in FIG. 10A, the aggregation structure changes at the temperature $T_2$, and phase separation and crystallization of the developer occur.

Further, in FIG. 10A, there may be a case where an erasing failure occurs such that it is not possible to carry out erasing even when heating is carried out to the erasing temperature if the increase of the temperature of the recording layer to the temperature $T_3$ greater than or equal to the melting temperature is repetitively carried out. It is considered that this is because the developer thermally decomposes and thus hardly aggregates or crystallizes, and thus, the developer hardly separates from the leuco dye. Degradation of the thermoreversible recording medium caused by the repetitions can be reduced, by reducing the difference between the melting temperature $T_1$ and the temperature $T_3$ in FIG. 10A when the thermoreversible recording medium is heated.

The thermoreversible recording medium may be suitably selected depending on the intended purpose without any restriction. The thermoreversible recording medium preferably includes a support member and a thermoreversible recording layer that is be provided on the support member and may contain a photothermal conversion material. Further, the thermoreversible recording medium preferably has another layer(s) that may be suitably selected as required such as a photothermal conversion layer, a first oxygen barrier layer, a second oxygen barrier layer, an ultraviolet absorbing layer, a back layer, a protective layer, an intermediate layer, an undercoat layer, an adhesive layer, a tackiness layer, a coloring layer, an air layer, a light reflective layer and/or the like.

Each of these layers may be formed in a single layer structure or a multi-layered structure. However, as for a layer(s) which is (are) provided over the photothermal conversion layer, in order to reduce energy loss of a laser beam of a specific wavelength to be emitted, each thereof is preferably formed of a material of less absorbing light of the specific wavelength.

Figure 11A:
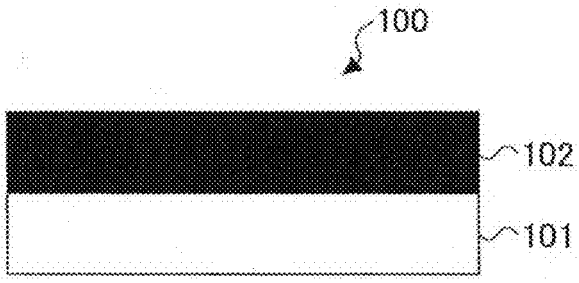
FIGS. 11A, 11B, 11C and 11D are general sectional views showing specific examples of a layer configuration of the thermoreversible recording medium.

The layer configuration of the above-mentioned thermoreversible recording medium is not particularly limited. For example, as shown in FIG. 11A, a mode of the layer configuration may be cited in which the thermoreversible recording medium 100 has a support member 101 and a thermoreversible recording layer 102 that is provided on the support member 101 and contains a photothermal conversion material.

Figure 11B:
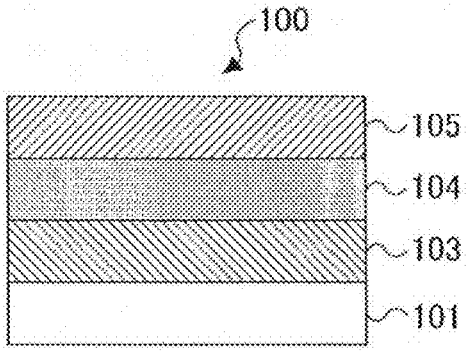

Further, as shown in FIG. 11B, a mode of the layer configuration may be cited in which the thermoreversible recording medium 100 has a support member 101, and a first thermoreversible recording layer 103, a photothermal conversion layer 104 and a second thermoreversible recording layer 105 in the stated order on the support member 101.

Figure 11C:
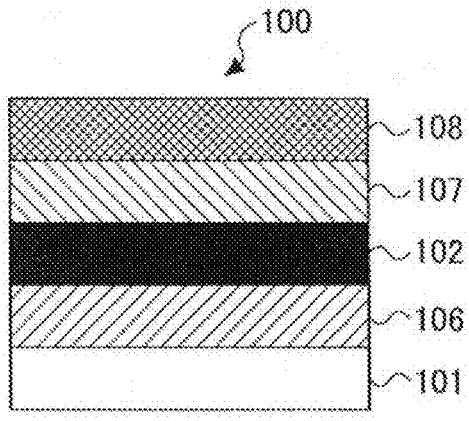

Furthermore, as shown in FIG. 11C, a mode of the layer configuration may be cited in which the thermoreversible recording medium 100 has a support member 101, and a first oxygen barrier layer 106, a thermoreversible recording layer 102 containing a photothermal conversion material, a second oxygen barrier layer 107 and an ultraviolet absorbing layer 108 in the stated order on the support member 101.

Figure 11D:
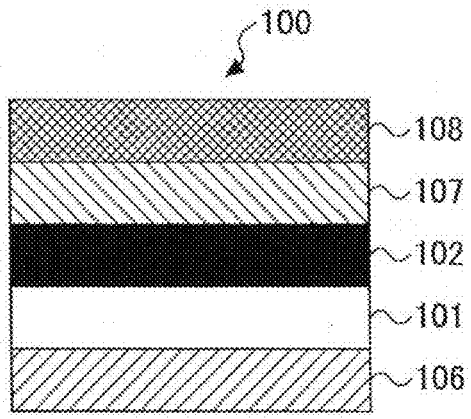

Further, as shown in FIG. 11D, a mode of the layer configuration may be cited in which the thermoreversible recording medium 100 has a support member 101, and a thermoreversible recording layer 102 containing a photothermal conversion material, a second oxygen barrier layer 107 and an ultraviolet absorbing layer 108 in the stated order on the support member 101, and further has a first oxygen barrier layer 106 on the surface of the support member 101 on the side not having the thermoreversible recording layer and so forth.

It is noted that although not shown, a protective layer may be formed on the thermoreversible recording layer 102 of FIG. 11A, on the second thermoreversible recording layer 105 of FIG. 11B, on the ultraviolet absorbing layer 108 of FIG. 11C and on the ultraviolet absorbing layer 108 of FIG. 11D, each thereof being provided as an outermost layer.

—Support Member—

The shape, structure, size and the like of the support member may be suitably selected depending on the intended purpose without any restriction. Examples of the shape include plate-like shapes; the structure may be a single layer structure or a multi-layered structure; and the size may be suitably selected according to the size of the thermoreversible recording medium and/or the like.

Examples of the material of the support member include, for example, inorganic materials and organic materials without any restriction.

Examples of the inorganic materials include glass, quartz, silicon, silicon oxides, aluminum oxides, $SiO_2$ and metals without any restriction.

Examples of the organic materials include paper, cellulose derivatives such as cellulose triacetate, synthetic paper, and films made of polyethylene terephthalate, polycarbonates, polystyrene, polymethyl methacrylate and the like without any restriction.

Each of the inorganic materials and the organic materials may be used alone or in combination of two or more thereof. Among these materials, the organic materials are preferable, and films made of polyethylene terephthalate, polycarbonates, polymethyl methacrylate and the like are preferable. Polyethylene terephthalate is particularly preferable thereamong.

Surface modification is preferably carried out on the support member by means of corona discharge, oxidation reaction (using chromic acid, for example), etching, increase of adhesion, antistatic treatment or the like for the purpose of improving the adhesiveness of the coating layer.

Also, it is preferable to color the support member white by adding, for example, a white pigment such as titanium oxide.

The thickness of the support member may be suitably selected depending on the intended purpose without any restriction. However, the range of 10 μm to 2000 μm is preferable and the range of 50 μm to 1000 μm is more preferable.

—Thermoreversible Recording Layer—

The color tone of the thermoreversible recording layer is reversibly changed.

The thermoreversible recording layer includes a leuco dye that acts as an electron donative coloration-type compound and a developer that acts as an electron-accepting compound and a binder resin. The thermoreversible recording layer may further include other components when needed.

The leuco dye acting as an electron donative coloration-type compound and the reversible developer acting as an electron-accepting compound, in which the color tone reversibly changes by heat, are materials capable of exhibiting a phenomenon in which visible changes are reversibly produced by a temperature change, and are capable of changing between relatively color formed state and color erased state depending on the difference in the heating temperature and the cooling rate after heating.

—Leuco Dye—

The leuco dye is a dye precursor which is colorless or pale per se. The leuco dye may be suitably selected from known leuco dyes without any restriction. Examples thereof include leuco compounds based on triphenylmethane phthalide, triallylmethane, fluoran, phenothiazine, thiofluoran, xanthene, indophthalyl, spiropyran, azaphthalide, chromenopyrazole, methine, rhodamineanilinolactam, rhodaminelactam, quinazoline, diazaxanthene and bislactone. Thereamong, leuco dyes based upon fluoran and phthalide are particularly preferable since they excel in properties of color forming and erasing, colors and retention quality. Each thereof may be used alone or in combination of two or more thereof. The thermoreversible recording medium can be used for multicolor and/or full-color recording by laminating layers in which different color tones are formed.

—Reversible Developer—

The reversible developer may be suitably selected depending on the intended purpose without any restriction as long as it is capable that color is reversibly formed and erased by a factor of heat. Suitable examples thereof include a compound having in its molecule at least one of the following structures: a structure (1) having color developing capability to cause the leuco dye to form color (for example, a phenolic hydroxyl group, a carboxylic acid group, a phosphate group or the like); and a structure (2) which controls cohesive force between molecules (for example, a structure in which long-chain hydrocarbon groups are linked together). In the linking part, the long-chain hydrocarbon groups may be linked via a divalent or greater linking group containing a hetero atom. Further, the long-chain hydrocarbon group may contain at least either the same or similar linking group or an aromatic group.

As the structure (1) having a color developing capability of causing the leuco dye to form color, phenol is particularly suitable.

As the structure (2) which controls cohesive force between molecules, a long-chain hydrocarbon group of the carbon number of 8 or greater is preferable. The carbon number of 11 or greater is more preferable. The upper limit of the carbon number is preferably 40 or less; and 30 or less is more preferable.

Among the reversible developers, a phenol compound expressed by the general formula (1) mentioned below is preferable, and a phenol compound expressed by the general formula (2) mentioned below is more preferable.

general formula (1)

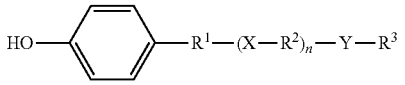

general formula (2)

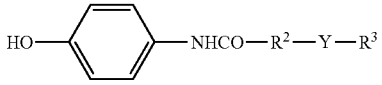

In these general formulas (1) and (2), $R^1$ denotes an aliphatic hydrocarbon group of a single bond or the carbon number of 1 to 24. $R^2$ denotes an aliphatic hydrocarbon group of the carbon number of two or greater, which may have a substituent, and the carbon number is preferably 5 or greater; and 10 or greater is more preferable. $R^3$ denotes an aliphatic hydrocarbon group of the carbon number of 1 to 35, and the carbon number is preferably 6 to 35; and 8 to 35 is more preferable. Each of these aliphatic hydrocarbon groups may be provided alone or in combination of two or more thereof.

As the sum of the carbon numbers of $R^1$, $R^2$ and $R^3$ may be suitably selected depending on the intended purpose without any restriction. However, its lower limit is preferably 8 or greater; and 11 or greater is more preferable. Its upper limit is preferably 40 or less; and 35 or less is more preferable.

When the sum of the carbon numbers is less than 8, color forming stability or color erasing properties may be degraded.

Each of the aliphatic hydrocarbon groups may be of a straight chain or a branched chain and may have an unsaturated bond. However, it is preferable that each of the aliphatic hydrocarbon groups is of a straight chain. Examples of the substituent bonded to the aliphatic hydrocarbon group include hydroxyl groups, a halogen atom and alkoxy groups.

In the above-mentioned general formulas (1) and (2), X and Y may be identical or different, and each denotes a divalent group containing a N atom(s) or an O atom(s). Specific examples thereof include an oxygen atom, amide groups, urea groups, diacylhydrazine groups, diamide oxalate groups and acyl urea groups. Thereamong, amide groups and urea groups are preferable.

In the general formula (1), "n" denotes an integer of 0 to 1.

As the electron-accepting compound (developer), there is no restriction. However, it is preferable that the electron-accepting compound (developer) is used together with a compound, as a color erasing accelerator, having in its molecule at least one or more of —NHCO— groups and —OCONH— groups.

This is because intermolecular interaction is induced between the color erasing accelerator and the developer in a process of producing the color erased state and thus there is an improvement in the color forming and color erasing properties.

The color erasing accelerator may be suitably selected depending on the intended purpose without any restriction.

In the thermoreversible recording layer, a binder resin and, if necessary, various additives for improving and/or controlling the coating properties and color forming and color erasing properties of the thermoreversible recording layer may be used. Examples of these additives include surfactants, conductive agents, filling agents, antioxidants, light stabilizers, color forming stabilizers and color erasing accelerators.

—Binder Resin—

The binder resin may be suitably selected depending on the intended purpose without any restriction as long as it enables the thermoreversible recording layer to be bound onto the support member. For example, one of conventionally known resins or a combination of two or more thereof may be used as the binder resin. Among these resins, resins capable of being cured by heat, an ultraviolet ray, an electron beam or the like are preferable since the durability at a time of the repetition (repetition durability) can be improved. In particular, thermosetting resins each using an isocyanate compound or the like as a cross-linking agent is preferable. Examples of the thermosetting resins include a resin having a group which reacts to a cross-linking agent, such as a hydroxyl group or a carboxyl group, and a resin produced by copolymerizing a monomer having a hydroxyl group, carboxyl group or the like and another monomer. Specific examples of such thermosetting resins include phenoxy resins, polyvinyl butyral resins, cellulose acetate propionate resins, cellulose acetate butyrate resins, acrylpolyol resins, polyester polyol resins and polyurethane polyol resins. Thereamong, acrylpolyol resins, polyester polyol resins and polyurethane polyol resins are particularly preferable.

The mixture ratio (mass ratio) between the color forming agent and the binder resin in the thermoreversible recording layer is preferably in the range of 1:0.1 to 1:10. When the amount of the binder resin is too small, the thermoreversible recording layer may be deficient in thermal strength. When the amount of the binder resin is too large, it may be problematic because the color optical density may decrease.

The above-mentioned cross-linking agent may be suitably selected depending on the intended purpose without any restriction, and examples thereof include isocyanates, amino resins, phenol resins, amines and epoxy compounds. Thereamong, isocyanates are preferable, and polyisocyanate compounds each having plural isocyanate groups are particularly preferable.

As to the additive amount of the cross-linking agent with respect to the binder resin, the ratio of the number of functional groups contained in the cross-linking agent to the number of active groups contained in the binder resin is preferably in the range of 0.01 to 2. When the ratio is so small as to be outside this range, sufficient thermal strength cannot be obtained. When the ratio is so large as to be outside this range, there is an adverse effect on the color forming and color erasing properties.

Further, as a cross-linking promoter, a catalyst used in this sort of reaction may be used.

The gel fraction of any of the thermosetting resins of the above-mentioned cases of carrying out thermal cross-linking is not particularly limited. It is preferably 30% or greater, 50% or greater is more preferable; and 70% or greater is still more preferable. When the gel fraction is less than 30%, an adequate cross-linked state cannot be produced, and thus there may be degradation of durability.

As a method of determining whether the binder resin is in a cross-linked state or a non-cross-linked state, it is possible to determine it by immersing the coating film in a solvent having high dissolving ability, for example. Specifically, with respect to the binder resin in a non-cross-linked state, the resin dissolves in the solvent and thus does not remain in a solute.

The other component(s) in the thermoreversible recording layer may be suitably selected depending on the intended purpose without any restriction. For example, a surfactant, a plasticizer and/or the like may be suitable from a point of view of achieving easiness of recording an image.

As to a solvent(s), a device of dispersing the coating solution, a coating method, a drying and curing method and the like for the thermoreversible recording layer coating solution, those known may be used.

In order to prepare the thermoreversible recording layer coating solution, the materials may be together dispersed into the solvent using the device of dispersing; or alternatively, the materials may be independently dispersed into the respective solvents and then the solutions may be mixed together. Further, the materials may be heated and dissolved, and then they may be precipitated by rapid cooling or slow cooling.

The method of forming the thermoreversible recording layer may be suitably selected depending on the intended purpose without any restriction. Suitable examples thereof include methods (1), (2) and (3). The method (1) is a method of applying onto the support member the thermoreversible recording layer coating solution in which the resin, the leuco dye and the reversible developer are dissolved or dispersed in the solvent, then cross-linking the coating solution while or after forming it into a sheet or the like by evaporation of the solvent. The method (2) is a method of applying onto the support member the thermoreversible recording layer coating solution in which the leuco dye and the reversible developer are dispersed in the solvent in which only the resin is dissolved, and then cross-linking the coating solution while or after forming it into a sheet or the like by evaporation of the solvent. The method (3) is a method of not using a solvent and heating and melting the resin, the leuco dye and the reversible developer so as to mix together, and then cross-linking this melted mixture after forming it into a sheet or the like and cooling it. In each of these methods, it is also possible to produce the thermoreversible recording layer as the thermoreversible recording medium in the form of a sheet without using the support member.

The solvent used in the method (1) or (2) cannot be generally defined, as it depends on the types and/or the like of the resin, the leuco dye and the reversible developer. Examples thereof include tetrahydrofuran, methyl ethyl ketone, methyl isobutyl ketone, chloroform, carbon tetrachloride, ethanol, toluene and benzene.

It is noted that the reversible developer is present in the thermoreversible recording layer, being dispersed in the form of particles.

A pigment, an antifoaming agent, a dispersant, a slip agent, an antiseptic agent, a cross-linking agent, a plasticizer and/or the like of various types may be added into the thermoreversible recording layer coating solution, for the purpose of exhibiting high performance as a coating material.

The coating method of the thermoreversible recording layer may be suitably selected depending on the intended purpose without any restriction. For example, a support member which is continuous in the form of a roll or which has been cut into the form of a sheet is conveyed, and the support member is coated with the thermoreversible recording layer by a known method such as blade coating, wire bar coating, spray coating, air knife coating, bead coating, curtain coating, gravure coating, kiss coating, reverse roll coating, dip coating or die coating.

The drying conditions of the thermoreversible recording layer coating solution may be suitably selected depending on the intended purpose without any restriction. For example, the recording layer coating solution is dried at room temperature to a temperature of 140° C., for approximately 10 sec to 10 min.

The thickness of the thermoreversible recording layer may be suitably selected depending on the intended purpose without any restriction. For example, it is preferably 1 μm to 20 μm; and 3 μm to 15 μm is more preferable. When the thermoreversible recording layer is too thin, the contrast of an image may be reduced because the color optic density may be reduced. When the recording layer is too thick, the heat distribution in the layer increases, a portion which does not reach the color forming temperature and so does not form color may be created, and thus a desired color optical density may be unable to be obtained.

—Photothermal Conversion Layer—

The photothermal conversion layer contains at least the photothermal conversion material having a role in absorbing laser light with high efficiency and generate heat. The photothermal conversion material may be added to at least one of the thermoreversible recording layer and a layer adjacent to the thermoreversible recording layer. In the case where the photothermal conversion material is added to the thermoreversible recording layer, the thermoreversible recording layer also serves as the photothermal conversion layer. A barrier layer may be formed between the thermoreversible recording layer and the photothermal conversion layer for the purpose of inhibiting an interaction therebetween. The barrier layer is preferably formed by using a material having high thermal conductivity. The layer inserted between the thermoreversible recording layer and the photothermal conversion layer may be suitably selected depending on the intended purpose without being limited thereto.

The photothermal conversion material can be broadly classified into inorganic materials and organic materials. Examples of the inorganic materials include carbon black, metals such as Ge, Bi, In, Te, Se, and Cr, semi-metals, alloys thereof, metallic boride particles, metallic oxide particles and the like.

Suitable examples of the metallic boride and metallic oxide include hexaborides, tungsten oxide compounds, antimony-doped tin oxide (ATO), indium tin oxide (ITO) and zinc antimonate.

As the organic material, there is no particular restriction and various dyes may be suitably used in accordance with the wavelength of light to be absorbed. However, when the laser diode is used as the light source, a near-infrared absorption pigment having an absorption peak within wavelengths of 700 nm to 1500 nm is used. Specific examples thereof include cyanine pigments, quinone pigments, quinoline derivatives of indonaphthol, phenylenediamine nickel complexes, and phthalocyanine compounds. In order to perform repetitive image processing, it is preferable to select a photothermal conversion material that is excel in heat resistance. Also from this point of view, phthalocyanine compounds are particularly preferable.

Each of the near-infrared absorption pigments may be used alone or in combination of two or more thereof.

When the photothermal conversion layer is provided, the photothermal conversion material is typically used in combination with a resin.

The resin used in the photothermal conversion layer may be suitably selected from among those known in the art without any restriction as long as it can maintain the inorganic material or the organic material therein. However, preferable examples thereof include thermoplastic resins and thermosetting resins, and one same as or similar to the binder resin used in the thermoreversible recording layer can be suitably used. Among them, resins curable by heat, ultraviolet light, an electron beam or the like may be preferably used for improving repetition durability, and a thermally cross-linkable resin using an isocyanate compound or the like as a cross-linking agent is particularly preferable. The binder resin preferably has a hydroxyl value of 50 mgKOH/g to 400 mgKOH/g. The thickness of the photothermal conversion layer may be suitably selected depending on the intended purpose without any restriction, but is preferably 0.1 μm to 20 μm.

—First and Second Oxygen Barrier Layers—

It is preferable that the first and second oxygen barrier layers (hereinafter, may be simply referred to as "barrier layers") are formed over and under the first and second thermoreversible recording layers, respectively so as to prevent oxygen from entering the thermoreversible recording medium to thereby prevent the photo-deterioration of the leuco dye contained in the first and second thermoreversible recording layers. Namely, it is preferable that the first oxygen barrier layer is formed between the support member and the first thermoreversible recording layer, and the second oxygen barrier layer is formed on the second thermoreversible recording layer.

Examples of the materials of forming the oxygen barrier layer include resins and polymer films, each of which has a large transmittance with visible light and low oxygen permeability. The oxygen barrier layer may be selected depending on the use thereof, oxygen permeability, transparency, easiness of coating, adhesiveness, and/or the like.

Specific examples of the oxygen barrier layer include a silica deposited film, an alumina deposited film, and a silica-alumina deposited film in all of which inorganic oxide is vapor deposited on a resin or polymer film. Here, examples of the resin include polyalkyl acrylate, polyalkyl methacrylate, polymethacrylonitrile, polyalkylvinyl ester, polyalkylvinyl ether, polyvinyl fluoride, polystyrene, vinyl acetate copolymer, cellulose acetate, polyvinyl alcohol, polyvinylidene chloride, acetonitrile copolymer, vinylidene chloride copolymer, poly(chlorotrifluoroethylene), ethylene-vinyl alcohol copolymer, polyacrylonitrile, acrylonitrile copolymer, polyethylene terephthalate, nylon 6 and polyacetal. Examples of the polymer film include those of polyethylene terephthalate and nylon. Among them, the film in which the inorganic oxide is deposited on the polymer film is preferable.

The oxygen permeability of the oxygen barrier layer is not particularly limited, and it is preferably 20 $ml/m^2/day/MPa$ or less; 5 $ml/m^2/day/MPa$ or less is more preferable; and 1 $ml/m^2/day/MPa$ or less is still more preferable. When the oxygen permeability thereof is greater than 20 $ml/m^2/day/MPa$, the photo-deterioration of the leuco dye contained in the first and second thermoreversible recording layers may not be prevented.

The oxygen permeability can be measured, for example, by the measuring method in accordance with JIS K7126 B.

The oxygen barrier layers may be formed so as to sandwich the thermoreversible recording layer by the first and second oxygen barrier layers, for example. Thus, the oxygen is efficiently prevented from entering the thermoreversible recording layer, and thus the photo-deterioration of the leuco dye can be reduced.

The method of forming the oxygen barrier layer may be suitably selected depending on the intended purpose without any restriction. Examples thereof include a melt extrusion, coating, laminating, and the like.

The thickness of each of the first and second oxygen barrier layers varies depending on the oxygen permeability of the resin or polymer film, but is preferably 0.1 μm to 100 μm. When the thickness thereof is less than 0.1 μm, the oxygen barrier may become insufficient. When the thickness thereof is greater than 100 μm, it is not preferable as the transparency thereof may be lowered.

An adhesive layer may be formed between the oxygen barrier layer and the underlying layer. The method of forming the adhesive layer is not particularly limited, and examples thereof include known coating and laminating.

The thickness of the adhesive layer is not particularly limited, but is preferably 0.1 μm to 5 μm. The adhesive layer may be cured with a cross-linking agent. As the cross-linking agent, those used in the above-mentioned thermoreversible recording layer may be suitably used.

—Protective Layer—

In the above-mentioned thermoreversible recording medium, it is preferable to provide the protective layer on the thermoreversible recording layer for the purpose of protecting the thermoreversible recording layer.

The protective layer may be suitably selected depending on the intended purpose without any restriction. For example, the protective layer may be formed from one or more layers, and it may be preferably provided on the outermost surface that is exposed.

The protective layer contains a binder resin and further contains another component(s) such as a filler, a lubricant, a coloring pigment and/or the like as necessary.

The binder resin in the protective layer may be suitably selected depending on the intended purpose without any restriction. For example, the resin is preferably a thermosetting resin, an ultraviolet (UV) curable resin, an electron beam curable resin or the like. Thereamong, an ultraviolet (UV) curable resin and a thermosetting resin are particularly preferable.

The UV curable resin can form a very hard film after being cured, and it is possible to reduce damage given by physical contact of the surface and deformation of the medium caused by laser heating. Thus, it is possible to obtain the thermoreversible recording medium superior in repetition durability.

Although slightly inferior to the UV curable resin, the thermosetting resin makes it possible to harden the surface as well and is superior in repetition durability.

The UV curable resin may be suitably selected from known UV curable resins depending on the intended purpose without any restriction. Examples thereof include oligomers based upon urethane acrylates, epoxy acrylates, polyester acrylates, polyether acrylates, vinyls and unsaturated polyesters; and monomers such as monofunctional and multifunctional acrylates, methacrylates, vinyl esters, ethylene derivatives and allyl compounds. Thereamong, tetrafunctional or greater multifunctional monomers and oligomers are particularly preferable. By mixing two or more of these monomers or oligomers, it is possible to suitably adjust the hardness, degree of contraction, flexibility, film strength and the like of the resin film.

In order to cure the monomer or the oligomer with an ultraviolet ray, it is necessary to use a photopolymerization initiator and/or a photopolymerization accelerator.

The additive amount of the photopolymerization initiator or the photopolymerization accelerator is not particularly limited and it is preferably 0.1% by mass to 20% by mass; and 1% by mass to 10% by mass is more preferable, with respect to the total mass of the resin component of the protective layer.

Ultraviolet irradiation to cure the ultraviolet curable resin can be conducted using a known ultraviolet irradiator, and examples of the ultraviolet irradiator include one equipped with a light source, a lamp fitting, a power source, a cooling unit, a conveyance unit and the like.

Examples of the light source include a mercury lamp, a metal halide lamp, a potassium lamp, a mercury-xenon lamp and a flash lamp. The wavelength of the light source may be suitably selected according to the ultraviolet absorption wavelength(s) of the photopolymerization initiator and/or the photopolymerization accelerator added to the thermoreversible recording medium composition.

The conditions of the ultraviolet irradiation may be suitably selected depending on the intended purpose without any restriction. For example, it is advisable to decide the lamp output, the conveyance speed and the like according to the irradiation energy necessary to cross-link the resin.

In order to make the conveyance capability sufficient, a silicon having a polymerizable group or a silicone-grafted polymer; a releasing agent such as wax or zinc stearate; and/or a lubricant such as silicone oil may be added. The additive amount of any one thereof is preferably 0.01% by mass to 50% by mass; and 0.1% by mass to 40% by mass is more preferable, with respect to the total mass of the resin component of the protective layer. Each thereof may be used alone or in combination of two or more thereof. Further, as a countermeasure against static electricity, a conductive filler is preferably used, and a needle-like conductive filler is more preferably used.

The particle diameter of the filler is not particularly limited, and, for example, is preferably 0.01 μm to 10.0 μm; and 0.05 μm to 8.0 μm is more preferable.

The additive amount of the filler is not particularly limited, is preferably 0.001 parts by mass to 2 parts by mass; and 0.005 parts by mass to 1 part by mass is more preferable, with respect to 1 part by mass of the resin.

It is noted that a surfactant, a leveling agent, an antistatic agent and/or the like that is/are conventionally known may be contained in the protective layer as an additive(s). The above-mentioned thermosetting resin is not particularly limited and a resin the same as or similar to the binder resin used in the thermoreversible recording layer may be suitably used, for example.

The above-mentioned thermosetting resin is preferably cross-linked. Thus, as the thermosetting resin, it is preferable to use one that has a group which reacts to a curing agent, such as a hydroxyl group, an amino group or a carboxyl group, and a hydroxyl group-containing polymer is particularly preferable. In order to increase the strength of the layer which contains the polymer having the ultraviolet absorbing structure, it is possible to obtain sufficient film strength by using the polymer having the hydroxyl value of 10 mgKOH/g or greater. It is more preferable to use the polymer having the hydroxyl value of 30 mgKOH/g or greater, and it is still more preferable to use of the polymer having the hydroxyl value of 40 mgKOH/g or greater. As a result of the protective layer thus having sufficient film strength, it is possible to reduce degradation of the thermoreversible recording medium even when image recording and erasing are repeatedly carried out.

The above-mentioned curing agent is not particularly limited, and for example, a curing agent the same as similar to the one used in the thermoreversible recording layer may be suitably used.

As to the solvent, coating solution dispersing device, protective layer coating method, drying method and the like for the protective layer coating solution, those known used for the above-mentioned recording layer may be used. When the ultraviolet curable resin is used, a curing step by means of the ultraviolet irradiation is required after coating and drying are carried out, in which case the ultraviolet irradiator, light source and irradiation conditions are those described above.

The thickness of the protective layer is not particularly limited, it is preferably 0.1 μm to 20 μm; 0.5 μm to 10 μm is more preferable; and 1.5 μm to 6 μm is still more preferable. When the thickness is less than 0.1 μm, the protective layer cannot fully perform the function as a protective layer of the thermoreversible recording medium, the thermoreversible recording medium may easily degrade through repeated use by heat, and thus it may become unable to be repeatedly used. When the thickness is greater than 20 μm, it is impossible to transmit sufficient heat to the thermosensitive part below the protective layer, and thus it may become unable to sufficiently carry out image recording and erasing by heat.

—Ultraviolet Absorbing Layer—

The ultraviolet absorbing layer is preferably provided in such a manner that the ultraviolet absorbing layer is on the side opposite to the support member with respect to the thermoreversible recording layer to avoid a residual that will be because of coloring of the leuco dye contained in the thermoreversible recording layer by ultraviolet light and photodeterioration thereof. With the ultraviolet absorbing layer, the light resistance of the recording medium is improved. It is preferable to select the thickness of the ultraviolet absorbing layer appropriately so as to absorb ultraviolet light having a wavelength of 390 nm or less.

The ultraviolet absorbing layer contains at least a binder resin and an ultraviolet absorber, and may further contain another component(s) such as a filler, a lubricant, a coloring pigment and/or the like, if necessary.

The binder resin may be suitably selected depending on the intended purpose without any restriction. The binder resin used in the thermoreversible recording layer or a resin component such as a thermoplastic resin or a thermosetting resin may be used as the binder resin. Examples of the resin component include polyethylene, polypropylene, polystyrene, polyvinyl alcohol, polyvinyl butyral, polyurethane, saturated polyester, unsaturated polyester, epoxy resins, phenol resins, polycarbonates and polyamide.

The ultraviolet absorber is not particularly limited and may be of an organic compound or an inorganic compound.

Moreover, it is preferable to use a polymer having an ultraviolet absorbing structure (hereinafter, may be referred as a "ultraviolet absorbing polymer"), as the ultraviolet absorber.

Here, the polymer having the ultraviolet absorbing structure means a polymer having an ultraviolet absorbing structure (for example, an ultraviolet absorbing group) in a molecule thereof. Examples of the ultraviolet absorbing structure include a salicylate structure, a cyanoacrylate structure, a benzotriazol structure and a benzophenone structure. Among them, the benzotriazol structure and the benzophenone structure are particularly preferable as they absorb the ultraviolet light having a wavelength of 340 nm to 400 nm which is a factor to cause a photo-deterioration of the leuco dye.

The ultraviolet absorbing polymer is not particularly limited, but is preferably cross-linked. Thus, it is preferable to use a polymer having a group that reacts to a curing agent, such as a hydroxyl group, an amino group and a carboxyl group, as the ultraviolet absorbing polymer. The polymer having a hydroxyl group is particularly preferable. In order to increase the physical strength of the layer containing the polymer having the ultraviolet absorbing structure, it is possible to obtain the sufficient film strength by using the polymer having the hydroxyl value of 10 mgKOH/g or greater. The polymer having the hydroxyl value of 30 mgKOH/g or greater is more preferable, and the polymer having the hydroxyl value of 40 mgKOH/g or greater is still more preferable. By thus providing the sufficient film strength, the deterioration of the recording medium can be reduced even after erasing and printing are repeatedly performed.

The thickness of the ultraviolet absorbing layer is not particularly limited, it is preferably 0.1 μm to 30 μm, and it is more preferably 0.5 μm to 20 μm. As to the solvent used for the ultraviolet absorbing layer coating solution, the dispersing device for the coating solution, the coating method of the ultraviolet absorbing layer, the drying and curing method of the ultraviolet absorbing layer and the like, those known used for the thermoreversible recording layer can be used.

—Intermediate Layer—

It is preferable to provide the intermediate layer between the thermoreversible recording layer and the protective layer, for the purpose of improving adhesiveness between the thermoreversible recording layer and the protective layer, preventing change in the quality of the recording layer caused by coating of the protective layer, and preventing the additives in the protective layer from transferring to the recording layer. This makes it possible to improve the retention quality for keeping a color formed image.

The intermediate layer contains at least a binder resin and further contains another component(s) such as a filler, a lubricant and/or a coloring pigment in accordance with the necessity.

The binder resin may be suitably selected depending on the intended purpose without any restriction. For the binder resin, the binder resin used for the thermoreversible recording layer or a resin component such as a thermoplastic resin or a thermosetting resin may be used. Examples of the resin component include polyethylene, polypropylene, polystyrene, polyvinyl alcohol, polyvinyl butyral, polyurethane, saturated polyester, unsaturated polyester, epoxy resins, phenol resins, polycarbonates and polyamide.

It is preferable that the intermediate layer contain an ultraviolet absorber. For the ultraviolet absorber, any one of an organic compound and an inorganic compound may be used.

Also, an ultraviolet absorbing polymer may be used, and this may be cured by means of a cross-linking agent. As these compounds, compounds the same as or similar to those used in the protective layer may be suitably used.

The thickness of the intermediate layer is not particularly limited and is preferably 0.1 μm to 20 μm; and 0.5 μm to 5 μm is more preferable. As to the solvent, the coating solution dispersing device, the intermediate layer coating method, the intermediate layer drying and the curing method and the like used for the intermediate layer coating solution, those that are known and used for the thermoreversible recording layer may be used.

—Under Layer—

An under layer may be provided between the thermoreversible recording layer and the support member, for the purpose of effectively utilizing applied heat for achieving high sensitivity, improving adhesiveness between the support member and the thermoreversible recording layer and/or preventing permeation of recording layer materials into the support member.

The under layer contains at least hollow particles, also contains a binder resin and further contains another component(s) in accordance with the necessity.

The hollow particles are not particular limited. Examples of the hollow particles include single hollow particles in which only one hollow portion is present in each particle, and multi hollow particles in which numerous hollow portions are present in each particle. These types of hollow particles may be used alone or in combination of two or more thereof.

The material of the hollow particles may be suitably selected depending on the intended purpose without any restriction, and suitable examples thereof include thermoplastic resins. As the hollow particles, suitably produced hollow particles may be used, or a commercially available product may be used. Examples of the commercially available product include MICROSPHERE R-300 (manufactured by Matsumoto Yushi-Seiyaku Co., Ltd.); ROPAQUE HP1055 and ROPAQUE HP433J (both of which are manufactured by Zeon Corporation); and SX866 (manufactured by JSR Corporation).

The additive amount of the hollow particles in the under layer is not particularly limited, and may be suitably selected depending on the intended purpose without any restriction. The additive amount of the hollow particles is preferably 10% by mass to 80% by mass, for example.

The binder resin is not particularly limited. A resin the same as or similar to the resin used in the thermoreversible recording layer or the resin used in the layer which contains the polymer having the ultraviolet absorbing structure may be used.

The under layer may contain at least one of inorganic fillers such as calcium carbonates, magnesium carbonates, titanium oxides, silicon oxides, aluminum hydroxides, kaolin and talc and various organic fillers.

It is noted that the under layer may further contain a lubricant, a surfactant, a dispersant and/or the like.

The thickness of the under layer may be suitably selected depending on the intended purpose without any restriction. However, the range of 0.1 μm to 50 μm is preferable, the range of 2 μm to 30 μm is more preferable, and the range of 12 μm to 24 μm is still more preferable.

—Back Layer—

For the purpose of preventing curling and electrostatic charging of the thermoreversible recording medium and improving the conveyance capability, the back layer may be provided on the surface of the support member opposite to the surface where the thermoreversible recording layer is formed.

The back layer contains at least a binder resin and further contains another component(s) such as a filler, a conductive filler, a lubricant and/or a coloring pigment in accordance with the necessity.

The binder resin may be suitably selected depending on the intended purpose without any restriction. For example, the binder resin is any one of a thermosetting resin, an ultraviolet (UV) curable resin, an electron beam curable resin and the like. Thereamong, an ultraviolet (UV) curable resin and a thermosetting resin are particular preferable.

As to the ultraviolet curable resin, the thermosetting resin, the filler, the conductive filler and the lubricant, ones the same as or similar to those used in the thermoreversible recording layer or the protective layer may be suitably used.

—Adhesive Layer or Tackiness Layer—

The thermoreversible recording medium can be produced as a thermoreversible recording label (for example, the above-mentioned rewritable label RL) by providing an adhesive layer or a tackiness layer on the surface of the support member opposite to the surface where the recording layer is formed. The material of the adhesive layer or the tackiness layer may be selected from commonly used materials without any restriction.

The material of the adhesive layer or the tackiness layer is not particularly limited and may be suitably selected depending on the intended purpose. Examples thereof include urea resins, melamine resins, phenol resins, epoxy resins, vinyl acetate resins, vinyl acetate-acrylic copolymers, ethylene-vinyl acetate copolymers, acrylic resins, polyvinyl ether resins, vinyl chloride-vinyl acetate copolymers, polystyrene resins, polyester resins, polyurethane resins, polyamide resins, chlorinated polyolefin resins, polyvinyl butyral resins, acrylic acid ester copolymers, methacrylic acid ester copolymers, natural rubber, cyanoacrylate resins, silicon resins and the like.

The material of the adhesive layer or the tackiness layer is not particularly limited and may be of a hot-melt type. Release paper may or may not be used. By thus providing the adhesive layer or the tackiness layer, the thermoreversible recording label can be affixed to a whole surface or a part of a thick substrate such as a vinyl chloride magnetic stripe card, which is difficult to coat with a recording layer. This makes it possible to improve the convenience of such a medium, for example to display a part of information magnetically stored in the magnetic stripe card. The thermoreversible recording label provided with such an adhesive layer or tackiness layer can also be used on any one of thick cards such as IC cards and optical cards.

In the thermoreversible recording medium, the coloring layer may be provided between the support member and the recording layer, for the purpose of improving visibility. The coloring layer can be formed by applying a solution or a fluid dispersion containing a colorant and a resin binder on a target surface, and drying the solution or fluid dispersion. Alternatively, the coloring layer can be formed by simply affixing a coloring sheet to the target surface.

The above-mentioned thermoreversible recording medium may be provided with a color printing layer. A colorant in the color printing layer is, for example, selected from various dyes, pigments and the like contained in color inks used for conventional full-color printing. Examples of the resin binder include various thermoplastic, thermosetting, ultraviolet curable and electron beam curable resins. The thickness of the color printing layer is changed according to a desired printing color density. Thus, the thickness of the color printing layer can be selected according to the desired printing color density without any restriction.

The thermoreversible recording medium is not particularly limited, and an irreversible recording layer may be used together. In this case, the color tones of the respective recording layers obtained from color forming may be identical or different. Also, a coloring layer which has been printed with any picture and/or the like by offset printing, gravure printing or the like or using an ink-jet printer, a thermal transfer printer, a sublimation printer or the like, for example, may be provided on the whole or a part of the same surface of the above-mentioned thermoreversible recording medium as the surface where the recording layer is formed, or may be provided on a part of the opposite surface thereof. Further, an overprint (OP) varnish layer composed mainly of a curable resin may be provided on a part or the whole surface of the coloring layer. Examples of the picture include letters/characters, patterns, diagram(s), photograph(s), and information to be detected with an infrared ray. Further, more simply, any of the respective layers of the thermoreversible recording medium may be colored by adding a dye or a pigment.

Further, the above-mentioned thermoreversible recording medium may be provided with a hologram for security. Also, to improve the design, it may also be provided with a design such as a portrait, a company emblem or a logo by forming depressions and protrusions in relief or in intaglio.

The thermoreversible recording medium may be formed into a desired shape according to its use, for example into a card shape, a tag shape, a label shape, a sheet shape or a roll shape. The thermoreversible recording medium in the form of a card can be used as a prepaid card, a discount card, a credit card or the like. The thermoreversible recording medium in the form of a tag that is smaller in size than the card can be used as a price tag or the like. The thermoreversible recording medium in the form of a tag that is larger in size than the card can be used as a ticket, a sheet for process control or for instructions of shipping, or the like. The thermoreversible recording medium in the form of a label can be affixed, and thus, it can be formed into a variety of sizes. For example, it can be used for process control, product control or the like, being affixed to a cart, a receptacle, a box, a container or the like that will be repeatedly used. The thermoreversible recording medium in the form of a sheet that is larger in size than the card provides a larger area of forming an image, and thus it can be used as a general document, a sheet of instructions for process control, or the like, for example.

—Examples of Combinations of Thermoreversible Recording Medium with RF-ID—

The above-mentioned thermoreversible recording medium becomes superior in convenience by providing the thermoreversible recording layer capable of reversible display and an information storage part in the same card or tag (so as to form a single unit), and displaying a part of information stored in the information storage part on the recording layer, thereby making it is possible to confirm the information by simply looking at the card or tag without needing any other special device. Also, by rewriting information displayed on the thermoreversible recording part when information stored in the information storage part is rewritten, it is possible to use the thermoreversible recording medium repeatedly as many times as desired.

Thus, according to the embodiments, it is possible to provide a laser rewriting apparatus which can sufficiently exhibit the performance whether it is positioned on either one side or the other side of a conveyance path.

Thus, the laser rewriting apparatuses have been described by the embodiments. However, the present invention is not limited to the embodiments, and variations and modifications may be made without departing from the scope of the present invention. For example, the erasing operation by the image erasing apparatus 14 and the recording operation by the image recording apparatus 16 are carried out in a state of the container C having been stopped according to the above-mentioned first, second, third and fourth embodiments. However, at least either the erasing operation or the recording operation may be carried out while the container C is being conveyed. However, it is preferable to carry out the recording operation by the image recording apparatus 16 in a state of the container C having been stopped in consideration of an influence of a vibration occurring in the roller conveyer RC on the recording operation. As a result, it is possible to avoid degradation of the quality of the recording image.

In the above-mentioned first, second, third and fourth embodiments, the erasing operation by the image erasing apparatus 14 and the recording operation by the image recording apparatus 16 are carried out in parallel. However, the erasing operation by the image erasing apparatus 14 and the recording operation by the image recording apparatus 16 may be carried out separately in sequence.

In any of the above-mentioned first, second, third and fourth embodiments, at least either a temperature sensor for detecting the temperature of the rewritable label RL or the ambient temperature thereof or a distance sensor for detecting the distance between each of the light emitting holes and the rewriteable label RL may be provided for the purpose of recording an image of high quantity and high durability on the rewritable label RL. In this case, based on the detection result(s) of the sensor(s), at least one of the laser light output, the scanning speed and the beam diameter is controlled and the laser light is emitted to the rewritable label RL.

In the above-mentioned first, second, third and fourth embodiments, the optical systems OC1 and OC2 of the image erasing apparatus 14 and the image recording apparatus 16 are of one example, and embodiments are not limited to such a configuration. For example, the arrangements of the plural optical elements included in the optical systems are not limited to those described above. Further, although the galvanometer mirror devices are used as deflecting devices, polygon mirror devices, stepping motor mirror devices or the like may be used instead.

In the above-mentioned first, second, third and fourth embodiments, the light emitting hole of each of the image erasing apparatus 14 and the image recording apparatus 16 is provided on one of the two adjacent side walls (the side wall on the +Y side or the −Y side) of the corresponding housing. However, embodiments are not limited to this configuration. For example, at least the light emitting hole of either the image erasing apparatus 14 or the image recording apparatus 16 is provided at an area extending across the border between two adjacent side walls (for example, the side wall on the +Y side or the −Y side and the side wall on the +X side or the −X side) of the corresponding housing, i.e., is provided at a corner of the housing.

In the above-mentioned first, second, third and fourth embodiments, the conveyance direction is the +X direction. However, a laser rewriting apparatus according to an embodiment of the present invention provides advantageous effects the same as or similar to the above-mentioned first, second, third and fourth embodiments even in a case where the conveyance direction is switched between the +X direction and the −X direction. That is, for example, in a case where the conveyance direction is the −X direction in a state of the laser rewriting apparatus in the embodiment being positioned on the −Y side of the conveyer unit 10, this state is the same as the above-mentioned second layout. Further, in a case where the conveyance direction is the −X direction in a state of the laser rewriting apparatus in the embodiment being positioned on the +Y side of the conveyer unit 10, this state is the same as the above-mentioned second layout.

The present application is based on Japanese Priority Application No. 2011-265372 filed Dec. 5, 2011, the entire contents of which are hereby incorporated herein by reference.

What is claimed is:

1. A laser rewriting apparatus positioned on one side or the other side of a conveyance path through which a to-be-conveyed object on which a thermoreversible recording medium is affixed is conveyed in a predetermined conveyance direction, wherein the laser rewriting apparatus emits laser light to the thermoreversible recording medium and rewrites an image, the laser rewriting apparatus comprising:

an image erasing apparatus that emits laser light to the thermoreversible recording medium on which the image is recorded and erases the image; and an image recording apparatus that is positioned on a downstream side of the predetermined conveyance direction of the image erasing apparatus and records a new image by emitting laser light to the thermoreversible recording medium from which the image has been erased by the image erasing apparatus, wherein the image erasing apparatus and the image recording apparatus have respective laser light emitting parts from which the laser light is emitted at ends of the same side with respect to the predetermined conveyance direction, and wherein an optical system in the image erasing apparatus is arranged in a "U" shape in a plan view, and wherein an optical system in the image recording apparatus is arranged in a "L" shape in a plan view.

2. The laser rewriting apparatus as in claim 1, wherein the image erasing apparatus and the image recording apparatus have respective housings, the laser light emitting part of the image erasing apparatus is provided on the housing of the image erasing apparatus at the end of an upstream side of the predetermined conveyance direction; and the laser light emitting part of the image recording apparatus is provided on the housing of the image recording apparatus at the end of the upstream side of the predetermined conveyance direction.

3. The laser rewriting apparatus as in claim 1, wherein the image erasing apparatus and the image recording apparatus have respective housings, the laser light emitting part of the image erasing apparatus is provided on the housing of the image erasing apparatus at the end of a downstream side of the predetermined conveyance direction; and the laser light emitting part of the image recording apparatus is provided on the housing of the image recording apparatus at the end of the downstream side of the predetermined conveyance direction.

4. The laser rewriting apparatus as in claim 1, wherein the image erasing apparatus and the image recording apparatus are arranged in close proximity to one another.

5. The laser rewriting apparatus as in claim 1, wherein a distance between a center of the image recording apparatus and a center of the laser light emitting part of the image recording apparatus with respect to the predetermined conveyance direction is equal to a distance between a center of the image erasing apparatus and a center of the laser light emitting part of the image erasing apparatus with respect to the predetermined conveyance direction.

6. The laser rewriting apparatus as in claim 1, wherein a distance between an edge of the most upstream side of the predetermined conveyance direction of the image erasing apparatus and an edge of the most downstream side of the predetermined conveyance direction of the image recording apparatus is less than twice a length of the predetermined conveyance direction of the to-be-conveyed object.

7. The laser rewriting apparatus as in claim 1, wherein a distance between an edge of the most upstream side of the predetermined conveyance direction of the laser light emitting part of the image erasing apparatus and an edge of the most downstream side of the predetermined conveyance direction of the laser light emitting part of the image recording apparatus is greater than a length of the predetermined conveyance direction of the to-be-conveyed object.

8. The laser rewriting apparatus as in claim 1, wherein the image erasing apparatus and the image recording apparatus have laser light sources that emit the laser light and optical systems that direct the laser light emitted from the laser light sources to the laser light emitting parts, respectively.

9. The laser rewriting apparatus as in claim 8, wherein the image erasing apparatus and the image recording apparatus have housings that house the corresponding optical systems, respectively, and each one of the housings has two adjacent side walls, and at least the laser light emitting part of either the image erasing apparatus or the image recording apparatus is provided on one of the two adjacent side walls.

10. The laser rewriting apparatus as in claim 8, wherein at least the laser light source of either the image erasing apparatus or the image recording apparatus includes a semiconductor laser.

11. The laser rewriting apparatus as claimed in claim 1, wherein the thermoreversible recording medium comprises:

a support member; and a thermoreversible recording layer that is provided on the support member, and includes a photothermal conversion material that absorbs laser light of a specific waveform and converts the laser light into heat, a leuco dye and a reversible developer, and has a color tone which reversibly changes depending on a temperature.

12. The laser rewriting apparatus as in claim 1, wherein a distance between the closest ends of the image erasing apparatus and the image recording apparatus is 40 cm or less.

* * * * *